US009458656B2

(12) United States Patent
Mickelson

(10) Patent No.: US 9,458,656 B2
(45) Date of Patent: Oct. 4, 2016

(54) INTERNALLY POWER SLIDER WITH HIGH TORQUE DRIVE SYSTEM

(75) Inventor: Brad Mickelson, San Diego, CA (US)

(73) Assignee: ANDERSEN CORPORATION, Bayport, MN (US)

( * ) Notice: Subject to any disclaimer, the term of this patent is extended or adjusted under 35 U.S.C. 154(b) by 695 days.

(21) Appl. No.: 12/377,561

(22) PCT Filed: Jun. 13, 2008 (Under 37 CFR 1.47)

(86) PCT No.: PCT/US2008/007442
§ 371 (c)(1), (2), (4) Date: Nov. 5, 2010

(87) PCT Pub. No.: WO2008/156696
PCT Pub. Date: Dec. 24, 2008

(65) Prior Publication Data

US 2012/0159853 A1 Jun. 28, 2012

Related U.S. Application Data

(63) Continuation-in-part of application No. 11/818,087, filed on Jun. 13, 2007, now abandoned.

(51) Int. Cl.
*E05F 11/00* (2006.01)
*E05F 15/06* (2006.01)
(Continued)

(52) U.S. Cl.
CPC ..... *E05F 15/06* (2013.01); *E05D 15/565* (2013.01); *E05F 15/56* (2015.01); *E05F 15/632* (2015.01);
(Continued)

(58) Field of Classification Search
CPC ..... E05F 15/06; E05F 15/56; E05F 15/632; E05F 15/638; E05D 15/565
USPC ..... 49/358, 360, 234, 235
See application file for complete search history.

(56) References Cited

U.S. PATENT DOCUMENTS 3,136,538 A 6/1964 Dimmit et al.
4,563,625 A 1/1986 Kornbrekke et al.
(Continued)

FOREIGN PATENT DOCUMENTS

DE 20 2010 000 634 U1 6/2011
EP 1 243 728 A1 9/2002
(Continued)

OTHER PUBLICATIONS

International Preliminary Report on Patentability issued Dec. 17, 2009, for PCT Application No. US2008/007442, filed Jun. 13, 2008; 7 pgs.
International Search Report mailed Nov. 12, 2008, for PCT Application No. US2008/007442, filed Jun. 13, 2008; 1 pg.
Written Opinion mailed Nov. 12, 2008, for PCT Application No. US2008/007442, filed Jun. 13, 2008; 6 pgs.

*Primary Examiner* — Jerry Redman
(74) *Attorney, Agent, or Firm* — Mueting, Raasch & Gebhardt, P.A.

(57) ABSTRACT

An internally powered sliding panel has a power source and drive train contained internally within the stiles and rails of a frame. A driven wheel is rotatably mounted on the frame and connected to the power source via the drive train. The panel may further include a lift system including a second power source, a lift mechanism, and a lift drive which are contained internally within the stiles and rails of the frame. The power sources, drive train, lift mechanism, and lift drive may be contained completely inside the stiles and rails of the frame. The movement of the panel along a fixed path, and the raising and lowering of the panel, may be regulated by a control system. The control system includes a microcontroller and sensor used to determine the position of the panel.

20 Claims, 26 Drawing Sheets

(51) Int. Cl.

| | |
|---|---|
| ***E05D 15/56*** | (2006.01) |
| ***E05F 15/56*** | (2015.01) |
| ***E05F 15/632*** | (2015.01) |
| ***E05F 15/638*** | (2015.01) |

(52) U.S. Cl.

CPC ..... *E05F 15/638* (2015.01); *E05Y 2201/406* (2013.01); *E05Y 2201/434* (2013.01); *E05Y 2201/674* (2013.01); *E05Y 2600/41* (2013.01); *E05Y 2600/46* (2013.01); *E05Y 2800/00* (2013.01); *E05Y 2800/21* (2013.01); *E05Y 2800/362* (2013.01); *E05Y 2800/364* (2013.01)

(56) References Cited

U.S. PATENT DOCUMENTS

| | | | | |
|---|---|---|---|---|
| 5,170,585 | A | 12/1992 | Wen | |
| 5,212,921 | A | 5/1993 | Unruh | |
| 5,341,600 | A | 8/1994 | Heppner | |
| 5,355,624 | A | 10/1994 | Bacon | |
| 5,634,298 | A | 6/1997 | Slopack | |
| 5,852,897 | A | 12/1998 | Sukale | |
| 6,073,394 | A | 6/2000 | Uhl | |
| 6,381,911 | B1 | 5/2002 | Weiland | |
| 6,449,905 | B2 * | 9/2002 | Maki | 49/360 |
| 6,581,332 | B1 * | 6/2003 | Kim | 49/358 |
| 6,792,651 | B2 | 9/2004 | Weiland et al. | |
| 7,591,106 | B2 | 9/2009 | Conlin | |
| 7,877,945 | B2 | 2/2011 | Eggen et al. | |
| 7,971,392 | B2 * | 7/2011 | Seo | 49/221 |
| 8,065,839 | B2 | 11/2011 | Conlin | |
| 8,132,370 | B2 | 3/2012 | Heppner | |
| 8,240,089 | B2 * | 8/2012 | Lambertini | 49/425 |
| 8,499,498 | B2 | 8/2013 | Heppner | |
| 8,533,997 | B2 | 9/2013 | Stoutenborough et al. | |
| 2002/0053169 | A1 | 5/2002 | Menuzzo | |
| 2004/0163317 | A1 * | 8/2004 | Reich et al. | 49/209 |
| 2005/0172563 | A1 * | 8/2005 | Komoda | 49/358 |
| 2005/0262782 | A1 | 12/2005 | Harrison et al. | |
| 2010/0050530 | A1 * | 3/2010 | Blasi | 49/358 |
| 2010/0269415 | A1 * | 10/2010 | Busch | 49/358 |
| 2010/0313480 | A1 * | 12/2010 | Verreault et al. | 49/358 |
| 2011/0061304 | A1 * | 3/2011 | Elliott et al. | 49/358 |
| 2011/0138692 | A1 * | 6/2011 | Lemstra | 49/349 |
| 2011/0203183 | A1 * | 8/2011 | Iwaki | 49/358 |
| 2012/0124909 | A1 | 5/2012 | Koch et al. | |
| 2012/0192490 | A1 * | 8/2012 | McCaslin | 49/31 |

FOREIGN PATENT DOCUMENTS

| | | | |
|---|---|---|---|
| EP | 1 298 271 | A2 | 9/2002 |
| EP | 1 681 419 | A1 | 7/2006 |
| EP | 2 484 853 | A1 | 8/2012 |
| WO | WO 2008/050992 | A1 | 5/2008 |
| WO | WO 2008/156696 | A1 | 12/2008 |

* cited by examiner

INTERNALLY POWER SLIDER WITH HIGH TORQUE DRIVE SYSTEM

The present application is a continuation of patent application of U.S. patent application Ser. No. 12/377,561 filed on Nov. 5, 2010, which is a U.S. National Stage Application of International Application No. PCT/US2008/007442, filed on Jun. 13, 2008, which is a Continuation-in-Part of U.S. patent application Ser. No. 11/818,087, filed Jun. 13, 2007, each of which is hereby incorporated by reference in its entirety.

FIELD OF THE INVENTION

The present invention relates generally to sliding panels, particularly powered sliding panels. Specifically, the present invention relates to sliding panels in which the power source is contained internally.

BACKGROUND

Sliding panels exist in several different forms. As used herein, the term "sliding" shall include, without limitation, rolling on wheels or the like. Furthermore, the term "panel" shall encompass the entire structure, including any frame and objects it supports, that moves across an opening in a wall, including, without limitation, windows and doors. The frame of the panel includes at least two spaced apart exterior surfaces, which may be planar or three-dimensional curved surfaces.

A common type of automated sliding panel is the automatic sliding door frequently found in supermarkets and other retail stores. When a sensor, typically a pressure sensor in the floor or a motion sensor above the door, detects the presence of a person in front of the door, the door opens. Generally the panel is slid open by an electric motor contained in a housing external to the door. The housing may be affixed to the wall above the doorway or built into the wall. The motor drives a belt, also contained in the housing, which is attached to the sliding panel, such that rotation of the motor causes translation of the panel.

A significant disadvantage of this design is the requirement of an external housing for the motor and drive system. An external housing is aesthetically disruptive if affixed to the wall above the door. While this may not be significant in some commercial or industrial settings, it is undesirable in residential or high-end commercial settings. Although it is possible to conceal the housing by installing it inside the wall, this is also undesirable because the housing is not easily accessible for maintenance.

Another example of an existing automatic sliding panel is an automatic gate commonly used on driveways or private roads. In this design, unlike the one previously discussed, the motor and drive system are carried along with the panel as it translates. The motor drives a drive train which rotates a wheel mounted on the bottom edge of the panel. However, the motor and drive system are not built into the panel, but rather are enclosed in a housing affixed to an outer surface of the panel. This external housing is a disadvantage of the design because it is not aesthetically pleasing and thus prevents it from being a solution for automation of indoor panels.

A disadvantage of most traditional sliding panels, including automatic sliding doors, is the poor seal between the bottom surface of the panel and the surface upon which it is sliding. The bottom surface of the panel cannot make contact with the surface upon which it is sliding because the friction between those surfaces would prevent efficient movement.

To overcome this problem, sliding doors have been designed such that the bottom surface of the door, when in the closed position, makes contact with the surface supporting the door. To overcome the problem of friction, the door is first lifted to a raised position to eliminate friction between the bottom surface of the panel and the support surface, and then slid open. After the door closes, it is lowered down to make a relatively weather tight seal.

A disadvantage of the lift and slide design is the difficulty of automating it. An automatic lift and slide panel must be capable of automatically raising, lowering, sliding open, and sliding closed. Because there are more components in an automatic lift and slide panel than there are in a non-lifting automatic sliding panel, it is even more difficult to fit them all inside the panel frame. This problem is magnified by the large amount of force required to raise a heavy panel off the support surface. As lift and slide panels are frequently used in applications where aesthetics are a paramount concern, it is extremely undesirable to have any externally mounted components or substantial protrusion of internal components.

Thus, although powered sliding panels and lift and slide panels are well known, the difficulty of fitting all of the required components into a relatively narrow panel frame has prevented any previous panel from being internally powered and driven. This is particularly true for lift and slide panels, which require a power source and drive system capable of exerting substantial forces. Although existing automatic panels are functional, they are not aesthetically pleasing and therefore they are not a good option for use in applications where aesthetics are important. Accordingly, there is a need for an improved sliding panel, both lifting and non-lifting, in which the power source and drive system is contained internally.

SUMMARY OF THE INVENTION

It is an object of the present invention to provide a new and improved sliding panel in which the power source is contained internally. It is another object of the present invention to provide a new and improved sliding panel in which the power source and drive train are both contained internally.

It is an object of the invention to provide a new and improved lift and slide panel in which the power source is contained internally. It is another object of the present invention to provide a new and improved lift and slide panel in which the power source, drive train, and lift system are all contained internally.

It is an object of the present invention to provide a control system that regulates the movement of automatic movable panels. It is a further object of the present invention to provide a control system that is internally contained in automatic panels.

According to one embodiment of the present invention, an internally powered sliding panel has a frame incorporating a pair of spaced apart exterior surfaces. As used herein, "frame" refers to the structure that provides support for the panel. The spaced apart exterior surfaces of the frame are any outer surfaces of the frame with space between them. As used herein, a component is "contained internally" if it is located substantially completely between the pair of spaced apart exterior surfaces of the frame, and substantially completely within the outer perimeter of the frame. In some embodiments, the frame has an inner perimeter and an outer perimeter, and the inner perimeter of the frame supports the outer edges of a pane. The panel has a power source that is contained internally, as well as a power supply that is used by the power source. The panel also has a drive train operatively connecting the power source to a driven wheel. Finally, the panel has a guide member that ensures the panel will only move along a fixed path.

In one exemplary embodiment, the pair of spaced apart exterior surfaces of the frame are flat and parallel. Alternatively, they are concentric, constant radius, three-dimensional curved surfaces. Also alternatively, the two surfaces merge such that they form a generally tubular member. In an exemplary embodiment, the inner perimeter of the frame holds the outer edges of a pane, which may be of any material, whether transparent or opaque. In this embodiment, the region between the inner perimeter of the frame and the outer perimeter of the frame is the space in which power and drive components are contained.

The power source is any source of power capable of driving a wheel via a drive train. In an exemplary embodiment, the power source is an electric motor. Alternatively, the power source is a servo motor, internal combustion engine, or pump for a hydraulic or pneumatic system. In one embodiment, the power source is contained completely inside the frame. As used herein, a component is contained "completely inside" the frame if no part of the component protrudes beyond any exterior surface of the frame or its inner or outer perimeter. In an exemplary embodiment the power source is an electric motor contained completely inside the stile of the frame.

The power supply is anything that provides energy to the power source. In one embodiment, the power supply is a supply of electricity, and in an exemplary embodiment it is a rechargeable battery. However, the power source may also be a pressurized fluid, an electrified track, or simply electrical wires. In one embodiment, the power source is contained internally, and in another it is contained completely inside the frame. In an exemplary embodiment, the power source is contained completely inside the stile of the frame.

The drive train is any device capable of transferring sufficient torque from the power source to a driven wheel, and in an exemplary embodiment it comprises a chain and sprocket drive or belt and pulley drive. In one embodiment, the drive train is contained internally, and in an exemplary embodiment it is contained completely inside the frame. The features of the invention are adaptable to use where, for example, the drive train is a gear train, a train of frictionally engaged rollers, a direct coupling between a motor and a wheel, or hydraulic or pneumatic tubing connected to a hydraulic or pneumatic motor that drives a wheel using the stored pressure created by a hydraulic or pneumatic pump acting as the power source.

The wheels of the present invention may be any structure capable of rollably supporting the panel. In an exemplary embodiment, the wheels are polyurethane wheels with a grooved profile that engage with a raised ridge that acts as a guide member. Alternatively, the wheel is a pinion gear that rollably engages with a rack, which acts as a guide member. The guide member is any structure that confines the movement of the panel to a fixed path. In an exemplary embodiment, it is a track with a raised ridge for engagement with wheels. In one embodiment, the guide member defines a fixed path which is a constant radius curve. In an alternative embodiment, it is an elongated groove that slidably constrains the sides of the frame.

In a first embodiment of the present invention, the first driven wheel is rotatably mounted on a wheel carriage that is contained substantially completely between the pair of spaced apart exterior surfaces and is fixedly or translatably mounted to the frame. In an exemplary embodiment there are additional wheels rotatably mounted on the wheel carriage, and one or more of these additional wheels may be driven. If there are additional driven wheels, they may be driven by an operative connection to the first driven wheel or directly to the power source. In the exemplary embodiment, this operative connection is a chain and sprocket set connecting the first driven wheel and the additional driven wheel.

According to an alternative configuration of the first embodiment, the panel further comprises a second wheel carriage contained substantially completely between the pair of spaced apart exterior surfaces and is mounted to the frame. The second wheel carriage is fixedly mounted to the frame or, alternatively, it is translatably mounted to the frame. One or more additional wheels are rotatably mounted on the second wheel carriage.

According to a second embodiment of the present invention, an internally powered lift and slide panel is provided having a frame with a pair of spaced apart exterior surfaces. The panel has a power source contained completely inside the frame. Also contained completely inside the frame of the panel is a drive train that operatively connects the power source to a driven wheel. The panel further has a first wheel carriage translatably mounted on the frame and contained completely between the pair of spaced apart exterior surfaces. The panel also includes a lift mechanism operatively connected to the first wheel carriage and a lift drive operatively connecting the power source to the lift mechanism. In an exemplary embodiment, the internally powered lift and slide panel further includes a power supply and drive train, both of which are contained completely inside the frame, as well as a driven wheel. In this embodiment, the power source is a pair of electric motors that are fixedly mounted completely inside the stiles of the frame. Alternatively, one or both of the electric motors is mounted on a wheel carriage.

The lift drive is any device capable of transferring sufficient torque from the power source to the lift mechanism. In various embodiments, it is contained internally or completely inside the frame. In an exemplary embodiment, the lift drive is contained completely inside a stile of the frame and is a chain and sprocket drive or belt and pulley drive. Alternatively, the lift drive comprises a gear train, a train of frictionally engaged rollers, a direct coupling between a motor and the lift mechanism, or some combination thereof. Also alternatively, the lift drive is hydraulic or pneumatic tubing connected to a hydraulic or pneumatic motor that drives the lift mechanism using the pressure created by a hydraulic or pneumatic pump that is the power source. In some of these alternative embodiments, the nature of the lift drive may make manual raising and lowering of the panel difficult without disengagement of the lift drive.

The lift mechanism is any device capable of using the force output by the lift drive to raise the panel relative to its support surface. In one embodiment, the lift mechanism is contained internally. In an exemplary embodiment, the lift mechanism is contained completely inside the frame and comprises a pushrod slidably mounted in the stile of the frame and two other members pivotally connected to the ends of the pushrod. One of these members is operatively connected to the lift drive while the other is operatively connected to the first wheel carriage, such that the translation of the pushrod along the stile causes translation of the first wheel carriage relative to the frame. In this exemplary embodiment, the lift mechanism further comprises a slide-block affixed to the frame and a lift pin affixed to the wheel carriage. The lift pin passes through a slanted hole in the slide-block, such that translation of the wheel carriage relative to the frame causes the frame to be raised or lowered. In another exemplary embodiment, the lift mechanism further comprises a second wheel carriage with a second slide-block and lift pin assembly, the second wheel carriage being rigidly connected to the first wheel carriage so that the two wheel carriages translate relative to the panel in unison. Also in an exemplary embodiment, the lift mechanism comprises a handle such that the panel may be raised and lowered manually by rotating the handle.

Alternatively, the lift mechanism is a lead screw, a rack and pinion, a spring and cable pairing, a hydraulic or pneumatic piston, or some combination thereof. Also alternatively, the lift mechanism is a linear chain-assembling device, known commonly as a Kataka® actuator. In some of these alternative embodiments, the nature of the lift mechanism may make manual raising and lowering of the panel difficult without disengagement of the lift mechanism.

According to another embodiment of the present invention, a control system is provided for controlling the translation of automatic sliding panels along a fixed path. In one embodiment, the control system comprises a plurality of sensors which are mounted on the panel and carried with it. One type of sensor detects the presence or absence of other objects. In an exemplary embodiment, this sensor is a magnetic sensor and it detects the presence or absence of magnets mounted at predetermined locations along the fixed path. Another sensor is an encoder that counts revolutions of a motor. In an exemplary embodiment, these sensors are monitored by a microcontroller which activates or deactivates the power source depending on the status of the sensors. Alternatively, the sensors directly activate or deactivate the motors via relays, without use of a microcontroller.

Also provided is an internally powered sliding panel in which a pane is carried by a frame around the perimeter of the pane, the frame having two vertical stiles connected to upper and lower rails. A power source and drive train are contained internally within the frame, and may be contained completely inside the frame within the stiles and/or rails. A wheel driven by the power source through the drive train is rotatably mounted on the frame. The wheel may be rotatably mounted on a wheel carriage which is fixedly or movably mounted on the frame.

The internally powered sliding panel may further include a lift system. A second wheel is rotatably mounted to a second wheel carriage which is fixedly or movably mounted on the frame. The internally powered sliding panel with lift system further includes a second power source, a lift mechanism, and a lift drive. The second power source, lift mechanism, and lift drive are contained internally within the frame and may be contained completely inside the stiles and/or rails. The second power source is connected to the lift mechanism via the lift drive and when activated moves the panel relative to a surface supporting the wheels of the panel so that the panel may be raised or lowered.

The internally powered sliding panel may further include a control system for determining and controlling the position of the panel along a fixed path. The position of the panel may be determined by a panel position sensor or a sensor that maintains a count of rotations of a wheel or electric motor. A microcontroller uses the signals provided by the sensors to determine and control the position of the panel along the fixed path.

According to another embodiment of the present invention, a method is provided for moving a plurality of stacking sliding panels supported on wheels along a fixed path from a fully closed position to a fully open position, wherein one of the panels is motor driven. First, the drive motor of the motor driven panel is activated at a first speed. The speed of the drive motor is decreased when the motor driven panel approaches another panel. The motor driven panel engages the other panel such that the other panel moves in unison with the motor driven panel. The drive motor returns to its first speed after successful engagement between the panels. Finally, the drive motor is deactivated when the motor driven panel reaches the fully open position.

According to another embodiment of the present invention, a method is provided for moving a plurality of lift and slide panels supported on wheels along a fixed path from a fully closed position to a fully open position, wherein all of the panels have a motorized lift system and one of the panels is motor driven. First, the bottom surface of every panel is raised out of contact with the surface supporting the wheels of the panels. Next, each panel transmits confirmation of its raised status to a logic module. Upon receiving confirmation, the logic module activates the drive motor of the motor driven panel at a first speed. Finally, the logic module deactivates the first motor when the logic module determines that the motor driven panel has reached the fully open position. In an exemplary embodiment, the communication between the logic module and other panels is performed wirelessly. Also in an exemplary embodiment, the logic module is a programmable microcontroller. In another exemplary embodiment, the motor driven panel slows as it approaches other panels, then returns to a first speed after engagement, such that the panels are stacked when in the open position.

In another embodiment of the present invention, a method is provided for determining the position of a motor driven sliding panel along a fixed path having at least three preset positions, wherein an object at each preset position has a physical property that is detectable by a sensor in the panel. The logic module monitors the current status of the sensor to determine if the panel is in a preset position. If the logic module determines that the panel is not in a preset position, it activates a drive motor at a low speed and continually monitors the current status of the sensor. Once a preset position is detected, the logic module determines which preset position the panel is in based on the status of several sensors.

According to yet another embodiment of the present invention, a method is provided for coordinating the movement of two motor driven sliding panels from an open and unengaged position to a fully closed and engaged position, wherein each panel travels along its own fixed path, the two paths intersecting at a corner. A first and second panel each activate their drive motors such that they both move toward the intersection. The second panel reaches the intersection first and then wirelessly transmits confirmation to the first panel. After the first panel receives confirmation, it activates its drive motor and begins moving toward the intersection. After the first panel reaches the intersection, engagement members lock the two panels together.

According to another embodiment of the present invention, a sliding electrical connector is provided for establishing and maintaining an electrical connection between neighboring lift and slide panels and a battery charger. Tapered engagement surfaces and slotted mounting holes ensure that connector pieces engage even if they are not perfectly aligned.

According to still another embodiment of the present invention, a collapsible light beam sensor is provided for detecting obstructions in the path of a moving panel. The light emitter and light detector are each contained in collapsible housings, which in an exemplary embodiment are hinged housings with torsional springs. The springs keep the housings deployed unless pressure is applied to collapse them into the panel.

Also provided is a method of moving a plurality of stacking sliding panels from a first position to a second position along a fixed path, wherein a first panel of the plurality of stacking sliding panels includes a drive motor. The drive motor of the first panel is activated when the first panel is in the first position, thus causing the first panel to move away from the first position and toward the second position at a first speed. The drive motor slows down causing the first panel to decelerate just before engaging a second panel. After engagement, the first panel accelerates (along with the second panel) and the two panels move in unison along the fixed path. Prior to reaching the second position, the drive motor slows down and the two panels thus decelerate. The drive motor is automatically deactivated when the first panel reaches the second position.

A method of moving a plurality of stacking lift and slide panels along a fixed path from a fully closed position to a fully open position is also provided. Each of the panels includes a wheel, a bottom and a lift system. At least a first panel includes a drive motor. When the first panel is in the fully closed position, the lift system of each panel is activated thus causing the bottoms of all of the panels to lift away from the surface supporting the wheels of the panels. Once in this raised position, a signal is wirelessly transmitted to a logic module. When the logic module receives the signal, the drive motor of the first panel is automatically activated to cause the first panel to move at a first speed away from the fully closed position and toward the fully open position along the fixed path. By automatically slowing the drive motor, the first panel decelerates just before engaging with a second panel. Just after engagement, the drive motor automatically increases in speed and the first and second panel accelerate in unison. Just before the first panel reaches the fully open position, the drive motor automatically slows and the first panel decelerates. Upon reaching the fully open position, the drive motor is automatically turned off and the first panel comes to a stop.

Also provided is a method of moving the plurality of stacking lift and slide panels along the fixed path from the fully open position back to the fully closed position. A signal is transmitted from the panels to a logic module to confirm that all of the panels are in the raised position. Upon receipt of this signal at the logic module, the drive motor of the first panel is automatically activated to cause the first panel to move at a first speed away from the fully open position and toward the fully closed position. By automatically slowing the drive motor, the first panel decelerates just before engaging with the second panel. Just after engagement, the drive motor automatically increases in speed and the first and second panel accelerate in unison. Just before the first panel reaches the fully closed position, the drive motor automatically slows and the first panel decelerates. Upon reaching the fully closed position, the drive motor is automatically turned off and the first panel comes to a stop. A second signal is transmitted to each of the panels causing the lift system in each panel to lower the bottom of each panel toward the surface supporting the wheels of the panels.

A method of coordinating the movement of two automatic sliding panels with drive systems along two paths intersecting at a corner is also provided. The drive system of a first panel is activated thus causing the first panel to move along a first of the two paths toward the intersection with a second of the two paths. When the first panel reaches the intersection its drive system is automatically deactivated and the first panel stops and transmits a signal to a second panel on the second path. When the second panel receives the signal, its drive system is activated and it moves toward the intersection. As the second panel reaches the intersection, an engagement member (e.g. a pin) on the second panel connecting with a complementary engagement member (e.g. an aperture) on the first panel. Upon reaching the intersection, the drive system of the second panel is automatically deactivated.

Also provided is a sensor for detecting obstructions in the path of an automatic sliding panel. The sensor includes two collapsible housings mounted in the leading edge of the panel. The first housing includes an aperture for emission of light (in any spectrum), and the second housing includes an aperture for reception of that light. A light emitter mounted in the first housing emits light which is received by a light detector in the second housing. When the leading panel approaches an obstruction, one or both of the housings collides with the obstructions and is caused to collapse into the panel. Such collapse causes the beam of light to no longer be received by the light detector, thus indicating an obstruction in the path of the panel before the leading edge of the panel contacts the obstruction. The housings are preferably hinged on one end and include springs, which may be torsional springs, to restore them to an extended position from a collapsed position.

DETAILED DESCRIPTION OF THE DRAWINGS

Exemplary embodiments of the invention are described in detail below with reference to the appended figures, wherein like elements are referenced with like numerals throughout. The figures are not necessarily drawn to scale and do not necessarily show every detail or structure of the various embodiments of the invention, but rather illustrate exemplary embodiments and mechanical features in order to provide an enabling description of such exemplary embodiments.

FIGS. 1 to 6 illustrate an internally powered automatic sliding panel 10 according to a first exemplary embodiment of the present invention. The panel of this embodiment basically comprises a pane 12 carried on a wheeled frame 14 which internally contains the power and drive components.

Figure 1:
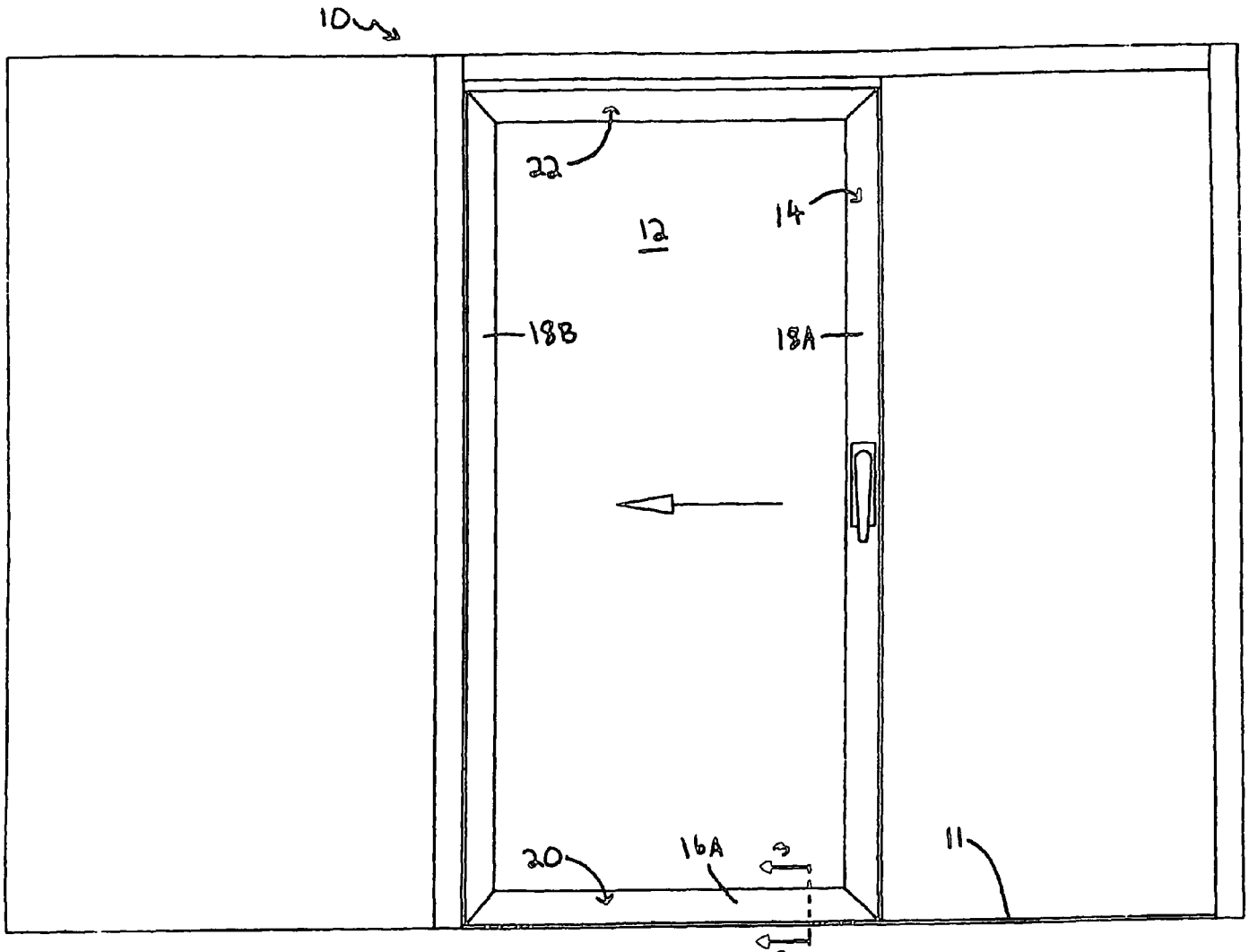
FIG. 1 is a front elevation view of an internally powered sliding panel according to a first embodiment of the present invention.
Figure 2:
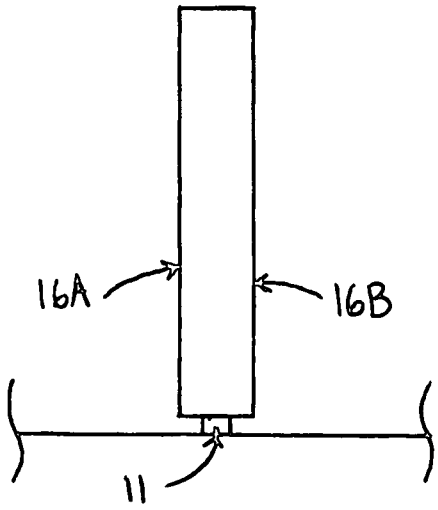
FIG. 2 is a side elevation view of the panel of FIG. 1.
Figure 3:
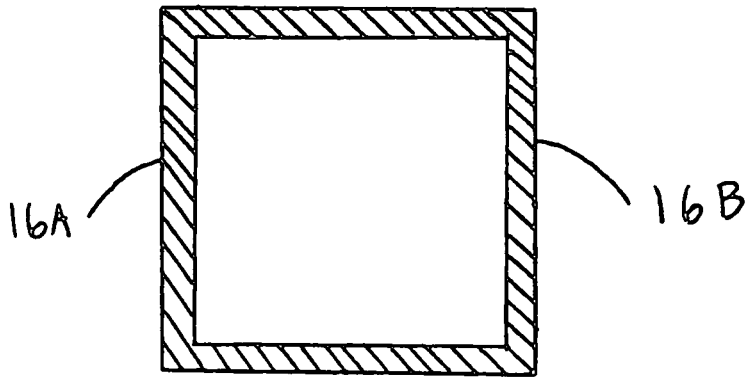
FIG. 3 is a cross-sectional view of the frame of the panel of FIG. 1.

As best seen in FIGS. 1 to 3, the frame 14 carries a pane 12 and comprises a pair of spaced apart exterior surfaces 16A and 16B. These surfaces 16 are joined by two other surfaces to form a generally hollow and enclosed region around the perimeter of the pane 12. The frame further comprises two stiles (a leading stile 18A and a trailing stile 18B), a lower rail 20, and an upper rail 22. In this embodiment, the pane 12 is a pane of glass that is thinner than the frame 14. However, in alternative embodiments, the pane 12 may be of any material and may be of equal thickness as the frame 14 such that the surfaces of the pane 12 are coplanar with the surfaces 16.

Figure 4:
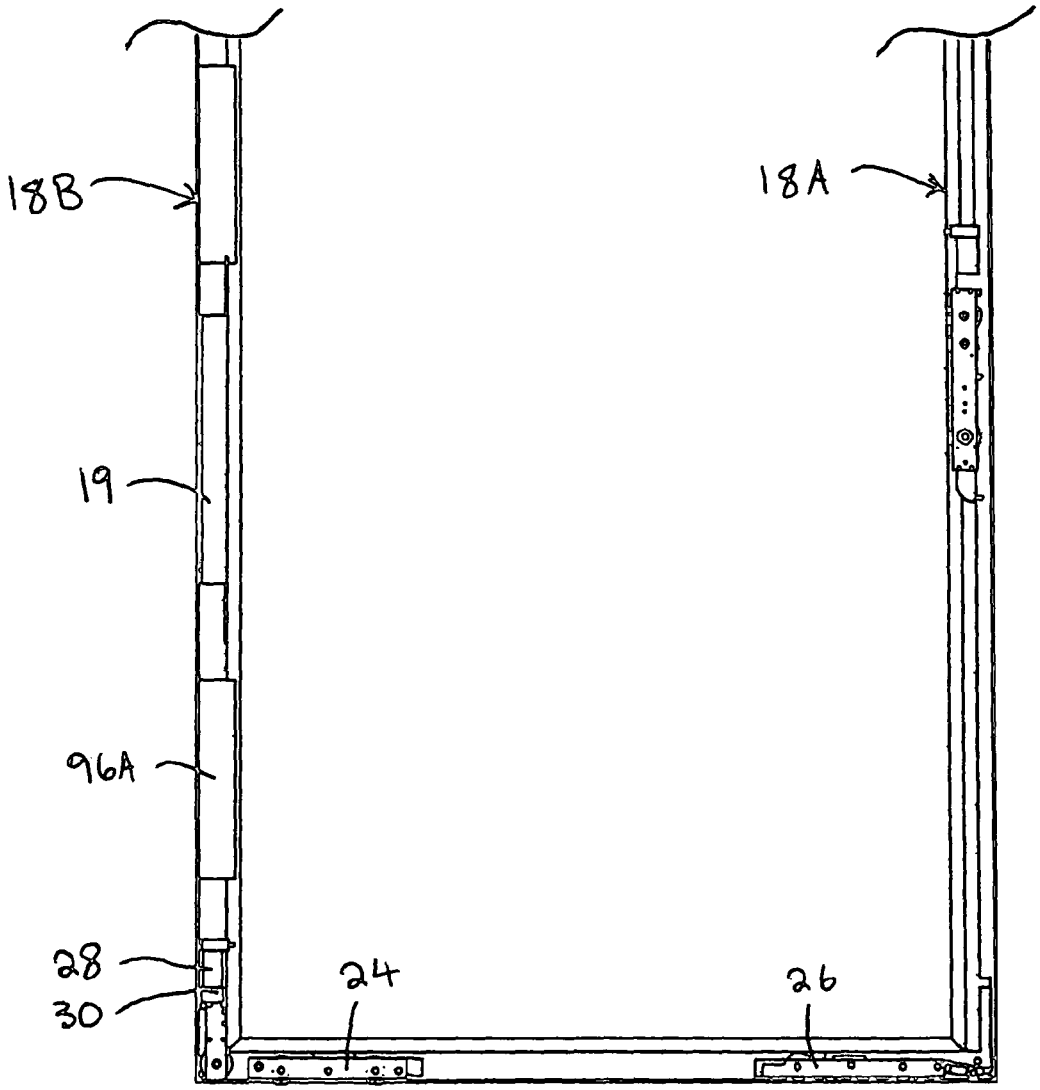
FIG. 4 is a front elevation view of the panel of FIG. 1, showing the components contained within the frame.
Figure 5:
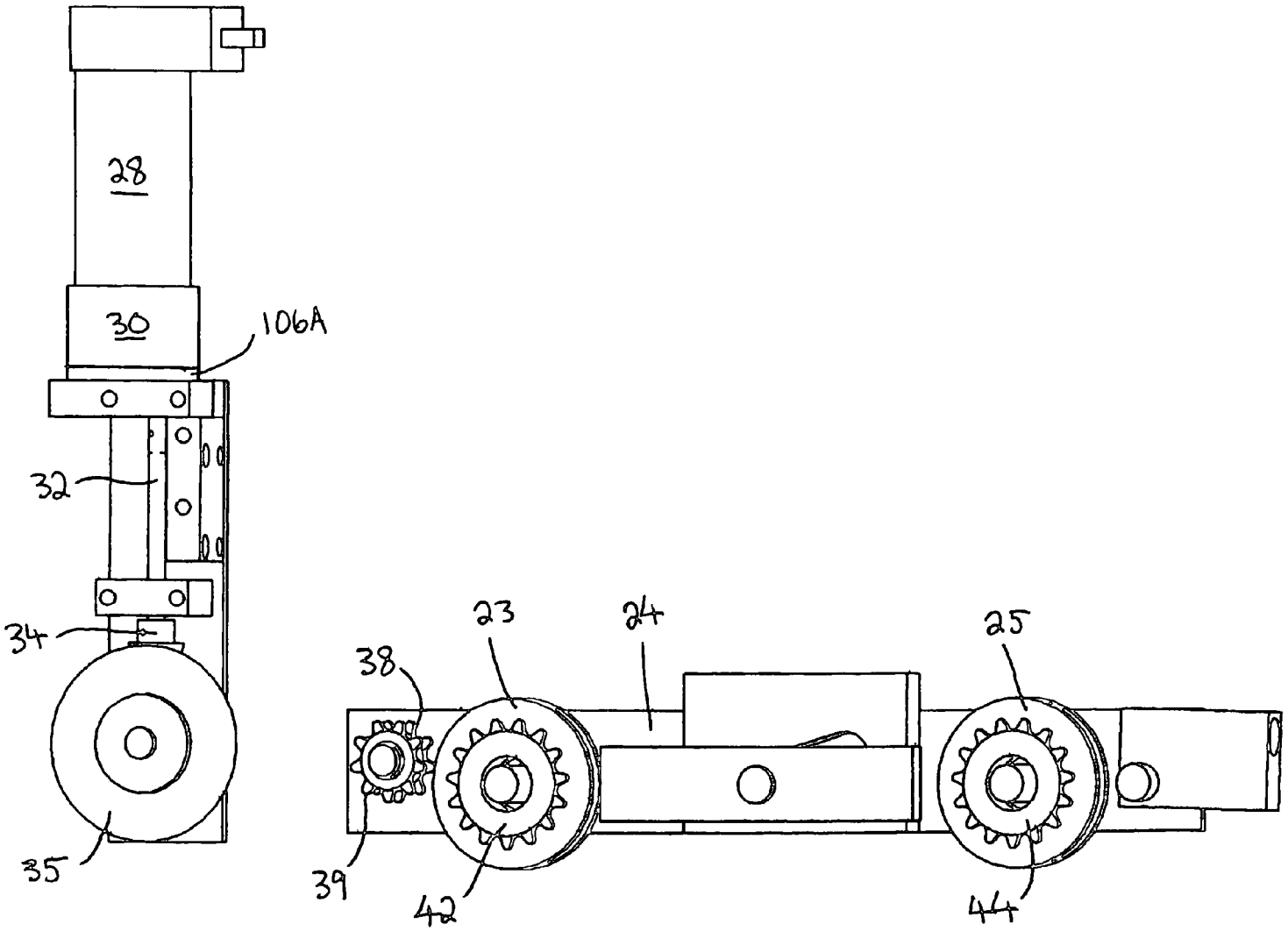
FIG. 5 is a front perspective view of the drive train of the panel of FIG. 1, with the frame not shown.
Figure 6:
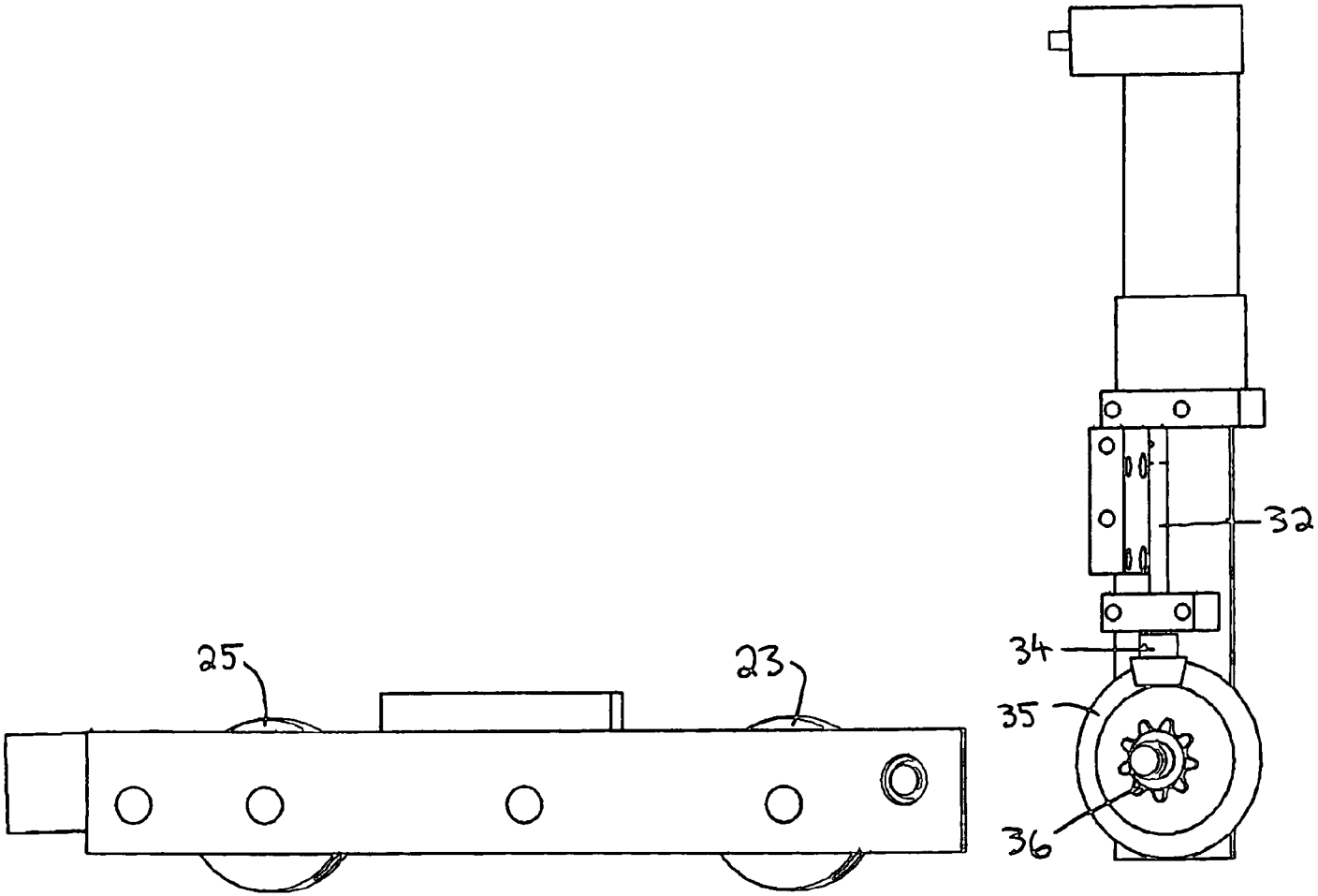
FIG. 6 is a back perspective view of the drive train of FIG. 5.

As illustrated by FIG. 4, partially enclosed in the lower rail 20 of the frame 14 is a first wheel carriage 24 and a second wheel carriage 26. As seen in FIGS. 5 and 6, the first wheel carriage 24 has two rotatably mounted wheels, a first driven wheel 23 and a second driven wheel 25. The second wheel carriage 26 has two rotatably mounted wheels 27, neither of which is a driven wheel. As best shown in FIG. 2, FIG. 5 and FIG. 6, all of the wheels have an indented profile such that their rolling surfaces are grooved. The groove in the wheels engages with a raised ridge running the length of the track 11. All of the wheels are made of a material that is soft enough to have a sufficiently high coefficient of friction to prevent slippage, yet hard enough that they do not permanently deform under the weight of a stationary panel. For example, in this exemplary embodiment, the wheels are made of polyurethane with a durometer of 95 A.

As shown in FIG. 4, the first motor 28 is contained completely inside the trailing stile 18B, and is fixedly mounted to the inside of frame 14 near the bottom of the trailing stile 18B. The first motor 28 is an electric motor with integral gearbox 30. The first motor 28 is connected to the battery 19 via a first motor controller 96A which modulates the current supplied to the first motor 28 in order to regulate the speed of the panel 10 along the track 11. The first motor 28, without the torque multiplication provided by the integral gearbox 30, is capable of sustaining 0.047 ft-lb of torque.

As best seen in FIGS. 5 and 6, the drive train operatively connecting the first motor 28 with the first driven wheel 23 and the second driven wheel 25 comprises a gearbox 30, a gearbox shaft 32, a first pinion gear 34, a first bevel gear 35, and two chain and sprocket sets. Although chain and sprocket sets are discussed herein and shown in the attached drawings, a belt and pulley set may be used anywhere a chain and sprocket set is used. The gearbox 30 is integral with the first motor 28 and has an output shaft 32 with a first pinion gear 34 fixedly and coaxially mounted on its end. The total reduction ratio of the integral gearbox 30 is 19.5:1. A first bevel gear 35 meshes with the first pinion gear 34. The gear ratio of the second bevel gear 35 to the first pinion gear 34 is 4:1.

A first sprocket 36 is fixedly and coaxially connected to the first bevel gear 35. A first chain (not shown) meshes with the first sprocket 36 and with a second sprocket 38, such that rotation of the first sprocket 36 causes proportional rotation of the second sprocket 38. The gear ratio of the second sprocket 38 to the first sprocket 36 is 1:1. The second sprocket 38 is fixedly and coaxially connected to a third sprocket 39. A second chain meshes with the third sprocket 39, a first wheel sprocket 42, and an identical second wheel sprocket 44, such that rotation of the third sprocket 39 causes proportional rotation of the wheel sprockets 42 and 44. The first and second wheel sprockets 42 and 44 are fixedly and coaxially connected to the first and second driven wheels 23 and 25 respectively. The gear ratio of the third sprocket 39 to the wheel sprockets is 15:9. The gear ratio of the first wheel sprocket 42 to the second wheel sprocket 44 is 1:1. Thus, the total torque multiplication and speed reduction provided by the entire drive train is 1170:9, or 130 to 1. Accordingly, the torque available at the output of the drive train is 4.9 ft-lb, based on an input torque of 0.047 ft-lb provided by the first motor 28.

The first driven wheel 23 and second driven wheel 25 are linked together by a chain in order to better distribute the power applied from the driven wheels 23 and 25 to the track 11. By applying the power through two wheels instead of one, the wheels are less likely to slip under heavy loads.

The power supply for the first motor 28 is a rechargeable battery 19 fixedly mounted to the frame 14 inside the stile 18. The battery 19 is rated at 24 VDC and comprises twenty 1.2V nickel metal hydride cells connected in series. The battery 19 has a profile designed to fit the contours of the inside of the frame 14. Wires routed inside the frame 14 provide electricity from the battery 19 to the first motor 28 and all other electrical components in the panel 10. The battery 19 is charged by the battery charger 104 (see FIG. 25) which is mounted separately from the panel 10.

Figure 7:
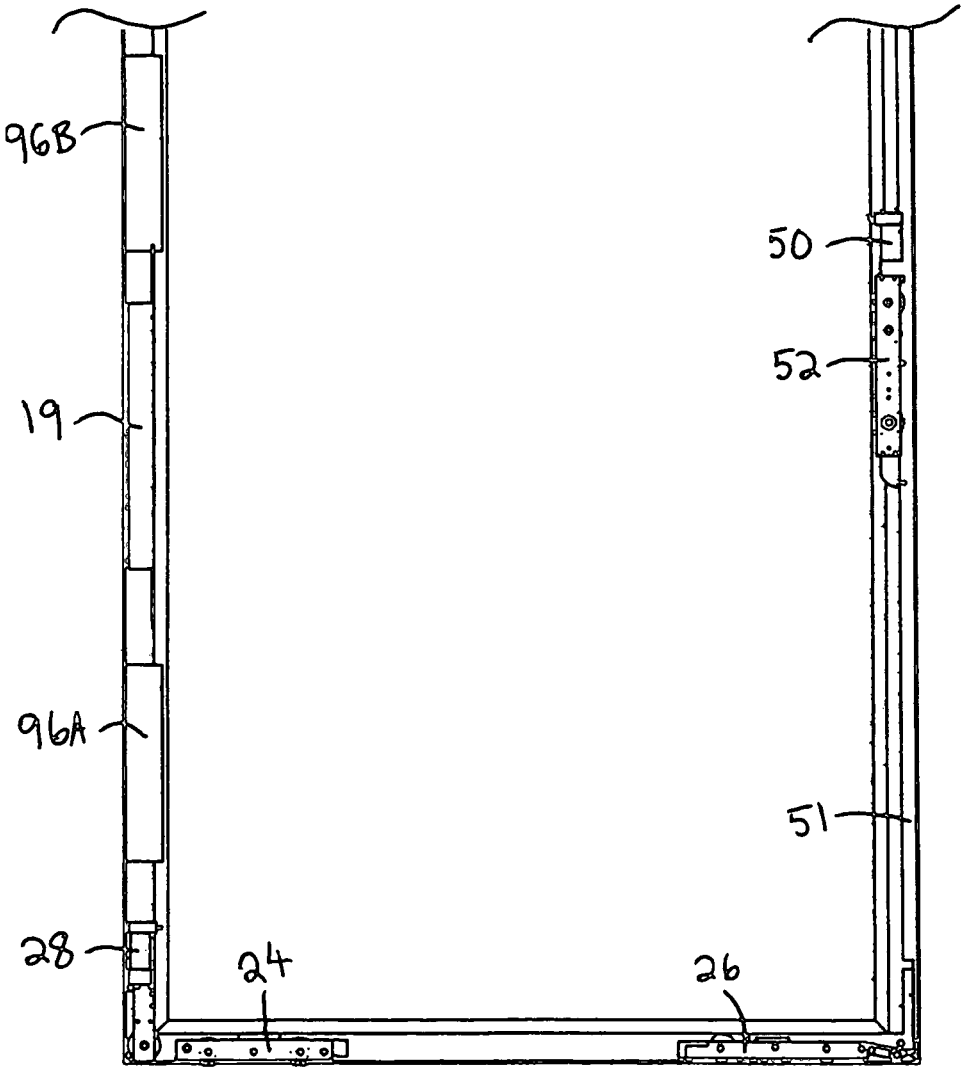
FIG. 7 is a front elevation view of an internally powered lift and slide panel according to a second embodiment of the present invention, showing the components inside the frame.

In a second exemplary embodiment of the present invention, illustrated in FIGS. 7 through 13, a lift system is added to the automatic sliding panel 10 of the first exemplary embodiment. As seen in FIG. 7, the lift system comprises a second motor 50, a lift mechanism 51, and a lift drive 52. The second motor 50 is an electric motor identical to the first motor 28, capable of sustaining 0.047 ft-lb of torque. It is connected to the battery 19 via a second motor controller 96B that modulates the current supplied to the second motor 50 in order to regulate the raising and lowering speed. The lift mechanism 51 is of a type commonly found in manual lift and slide doors and is manufactured by, for example, Gretsch-Unitas GmbH of Ditzingen, Germany. The lift drive 52 operatively connects the second motor 50 to the lift mechanism 51.

As seen in FIG. 7, the lift mechanism 51 is mounted inside the leading stile 18A of the frame 14. As shown in FIGS. 8 through 11, it comprises a five member mechanical linkage plus a slide-block assembly. Each of the five members of the mechanical linkage has an input end (A) and an output end (B). The first member is a crank arm 66 having an input end 66A fixedly and coaxially connected to a handle shaft 63. This handle shaft 63, and thus the crank arm 66, can either be rotated by the handle 64 that is affixed to it, or by the output of the lift drive 52, as explained in further detail below.

Figure 8:
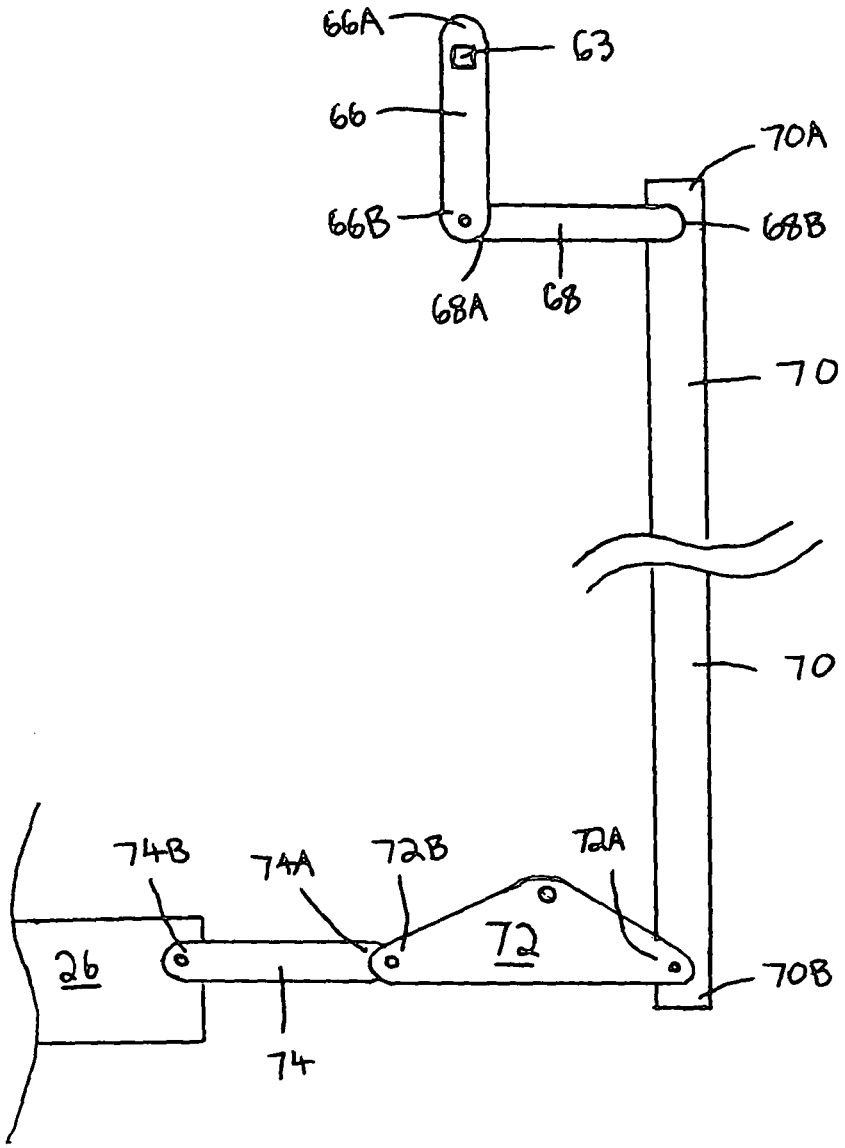
FIG. 8 is a front elevation view of the lift mechanism of the panel of FIG. 7, showing the lift mechanism in the lowered position, with the middle portion of one member not shown.
Figure 9:
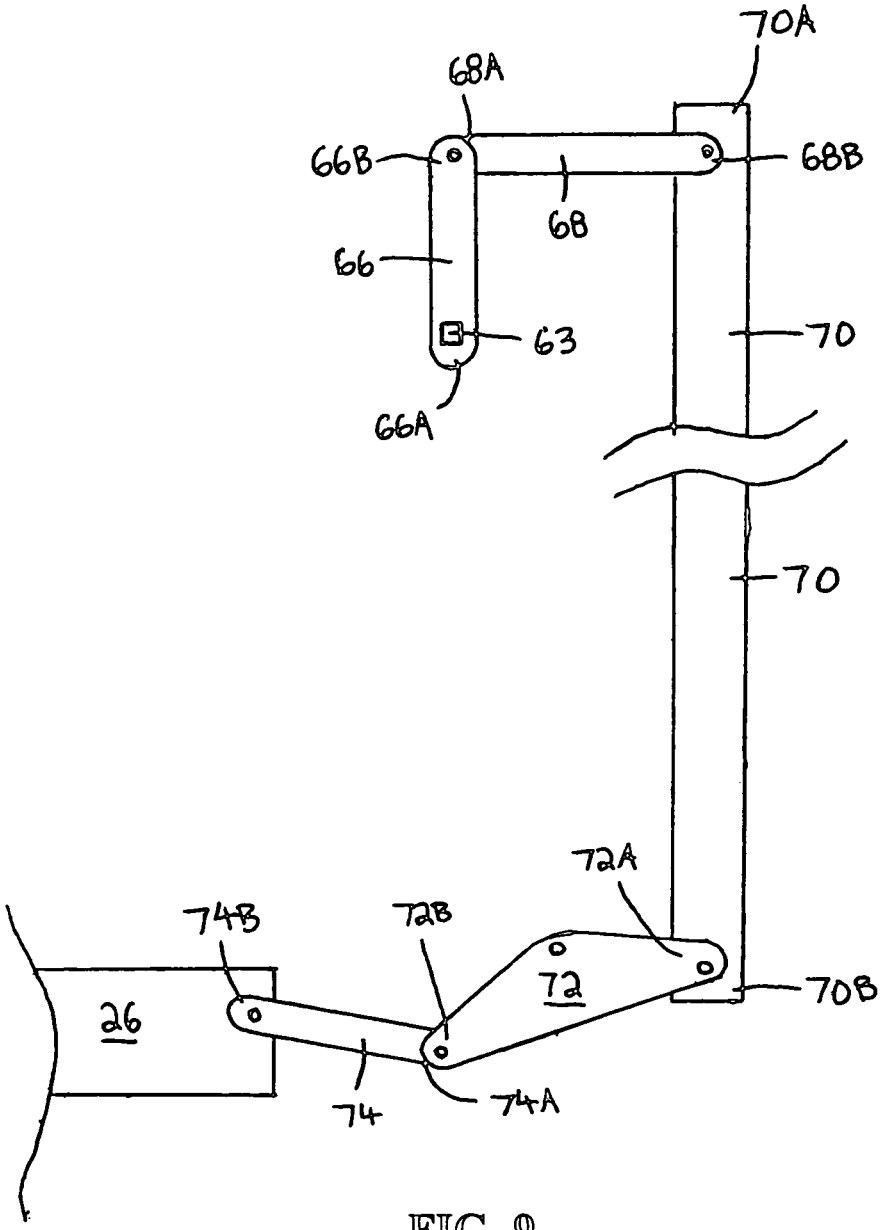
FIG. 9 is a front elevation view of the lift mechanism of FIG. 8, showing the lift mechanism in the raised position, with the middle portion of one member not shown.

The output end 66B of the crank arm 66 is pivotally connected to the input end 68A of a first joint member 68. The output end 68B of the first joint member 68 is pivotally connected to the input end 70A of a pushrod 70 that is slidably mounted inside and parallel to the leading stile 18A. As the crank arm 66 rotates clockwise (as viewed in FIGS. 8 and 9), the pushrod 70 slides toward the lower rail 20 of the frame 14 until the mechanism is in the fully lowered position, as shown in FIG. 8. As the crank arm 66 rotates counterclockwise, the pushrod 70 slides toward the upper rail 22 of the frame 14 until the mechanism is in the fully raised position, as shown in FIG. 9.

Figure 10:
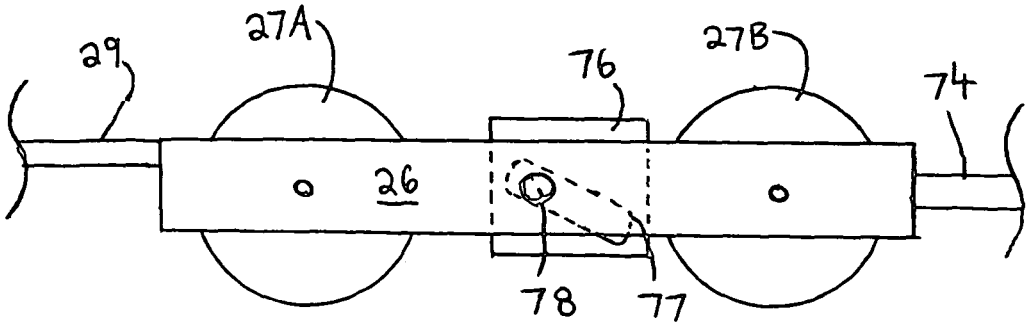
FIG. 10 is a front elevation view of the second wheel carriage of the panel of FIG. 7, shown in the lowered position.
Figure 11:
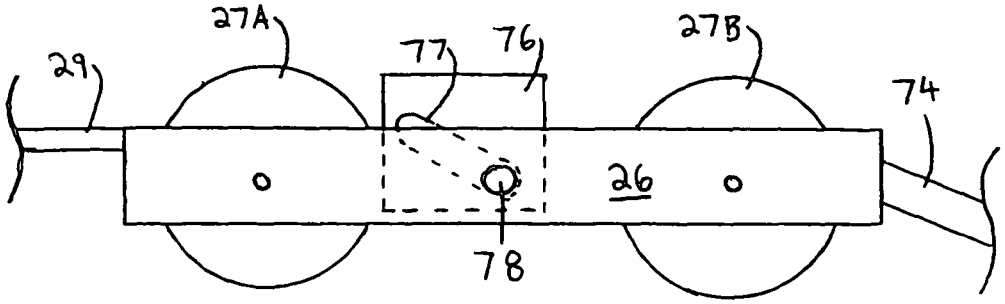
FIG. 11 is a front elevation view of the wheel carriage of FIG. 10, shown in the raised position.

The output end 70B of the pushrod 70 is pivotally connected to the input end 72A of a second joint member 72. The output end 72B of the second joint member 72 is pivotally connected to the input end 74A of a connector arm 74. As shown in FIGS. 10 and 11, the output end 74B of the connector arm 74 is pivotally connected to the leading end of the second wheel carriage 26. The second wheel carriage 26 is fixedly and rigidly connected to the first wheel carriage 24 by a connecting rod 29, such that the two wheel carriages translate relative to the frame in unison. Lift pins 78 are affixed to both the first wheel carriage 24 and the second wheel carriage 26, at a location halfway between the wheels of each carriage. Two slide-blocks 76 are fixedly mounted to the inside of the lower rail 20 of the frame 14. The slide-blocks 76 support substantially all of the weight of the frame 14, and the slide-blocks 76 are in turn supported by the lift pins 78. Each slide-block 76 has a slanted hole 77 that slidably mates with a lift pin 78. The slanted hole 77 slopes toward the upper rail 22 from leading edge to trailing edge.

When the crank arm 66 turns clockwise, thus pulling the pushrod 70 toward the track 11, the connector arm 74 pushes the second wheel carriage 26 toward the trailing side of the panel 10. Because the connecting rod 29 rigidly connects the two wheel carriages, any translation of the second wheel carriage 26 is matched by a one-to-one translation of the first wheel carriage 24. As the wheel carriages translate relative to the panel 10 due to the force exerted by the connector arm 74, the lift pins 78 slide along the slanted holes 77 in the slide-blocks 76. The relative motion of the lift pins 78 and the slanted holes 77 forces the slide-blocks 76 to move toward the track 11. Because the slide blocks 76 are fixedly mounted on the frame 14, the frame 14 is forced toward the track 11 as the crank arm 66 turns clockwise. When the pins 78 reach the upper termini of the slanted holes 77, the panel 10 is in the fully lowered position, as shown in FIG. 10. To reverse the process, the crank arm 66 is turned counterclockwise, thus pulling the pushrod 70 toward the upper rail 22, which pulls the wheel carriages toward the leading edge of the panel 10 and causes the lift pins 78 to travel to the lower termini of the slanted holes 77, thus forcing the frame 14 away from the track 11 into a fully raised position, as shown in FIG. 11.

Figure 12:
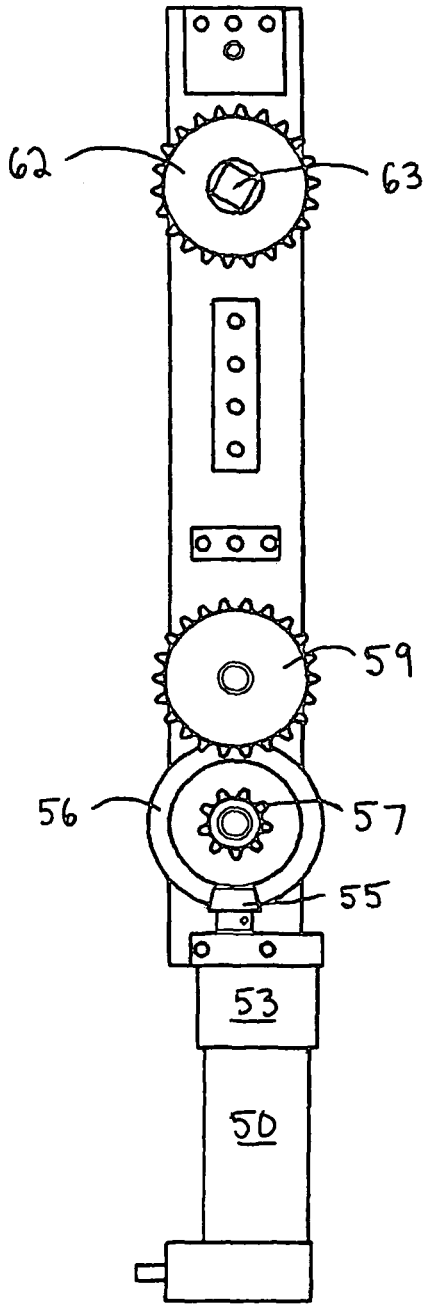
FIG. 12 is a front elevation view of the lift drive of the panel of FIG. 7.
Figure 13:
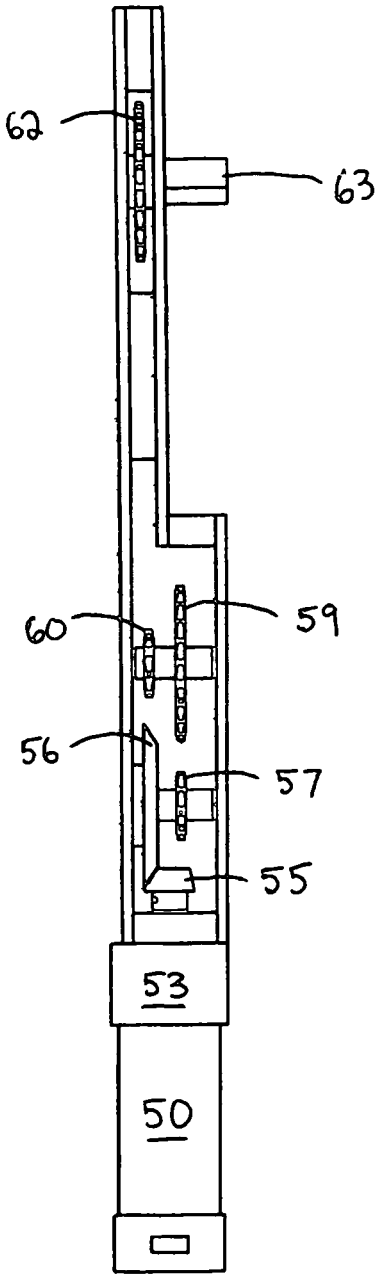
FIG. 13 is a side elevation view of the lift drive of FIG. 12.

The crank arm 66 may be rotated either manually by a handle 64 or automatically by a lift drive 52 operatively connected to the second motor 50. The handle 64 may be used without disengaging or otherwise disconnecting the lift drive 52 from the lift mechanism 51. As illustrated in FIGS. 12 and 13, the lift drive 52 begins with a gearbox 53 connected to the shaft of the second motor 50. The reduction ratio of the gearbox is 19.5:1. A second pinion gear 55 is fixedly and coaxially mounted on the output shaft 54 of the gearbox 53. The second pinion gear 55 meshes with a second bevel gear 56. The gear ratio of the second bevel gear 56 to the second pinion gear 55 is 4:1. The second bevel gear 56 is fixedly and coaxially connected to a fourth sprocket 57. A third chain (not shown) meshes with the fourth sprocket 57 and a fifth sprocket 59, such that rotation of the fourth sprocket 57 causes a proportional rotation of the fifth sprocket 59. The gear ratio of the fifth sprocket 59 to the fourth sprocket 57 is 22:9.

The fifth sprocket 59 is fixedly and coaxially connected to a sixth sprocket 60. A fourth chain (not shown) meshes with the sixth sprocket 60 and a handle sprocket 62, such that rotation of the sixth sprocket 60 causes proportional rotation of the handle sprocket 62. The gear ratio of the handle sprocket to the sixth sprocket is 22:9. The handle sprocket 62 is fixedly and coaxially mounted on the handle shaft 63, to which the crank arm 66 is also fixedly mounted. Thus, the total torque multiplication of the entire lift drive is 37,752:81, or approximately 466 to 1. Therefore, the lift drive is capable of sustaining an output of approximately 17.5 ft-lb of torque based on an input torque of 0.047 ft-lb provided by the second motor 50. As an illustrative example, a typical panel 10 weighs approximately 400 lbs and requires approximately 7 ft-lb to be lifted. Thus, the lift drive is capable of lifting larger panels than are found in typical installations. This allows the same lift system to be installed in much larger panels.

Figure 25:
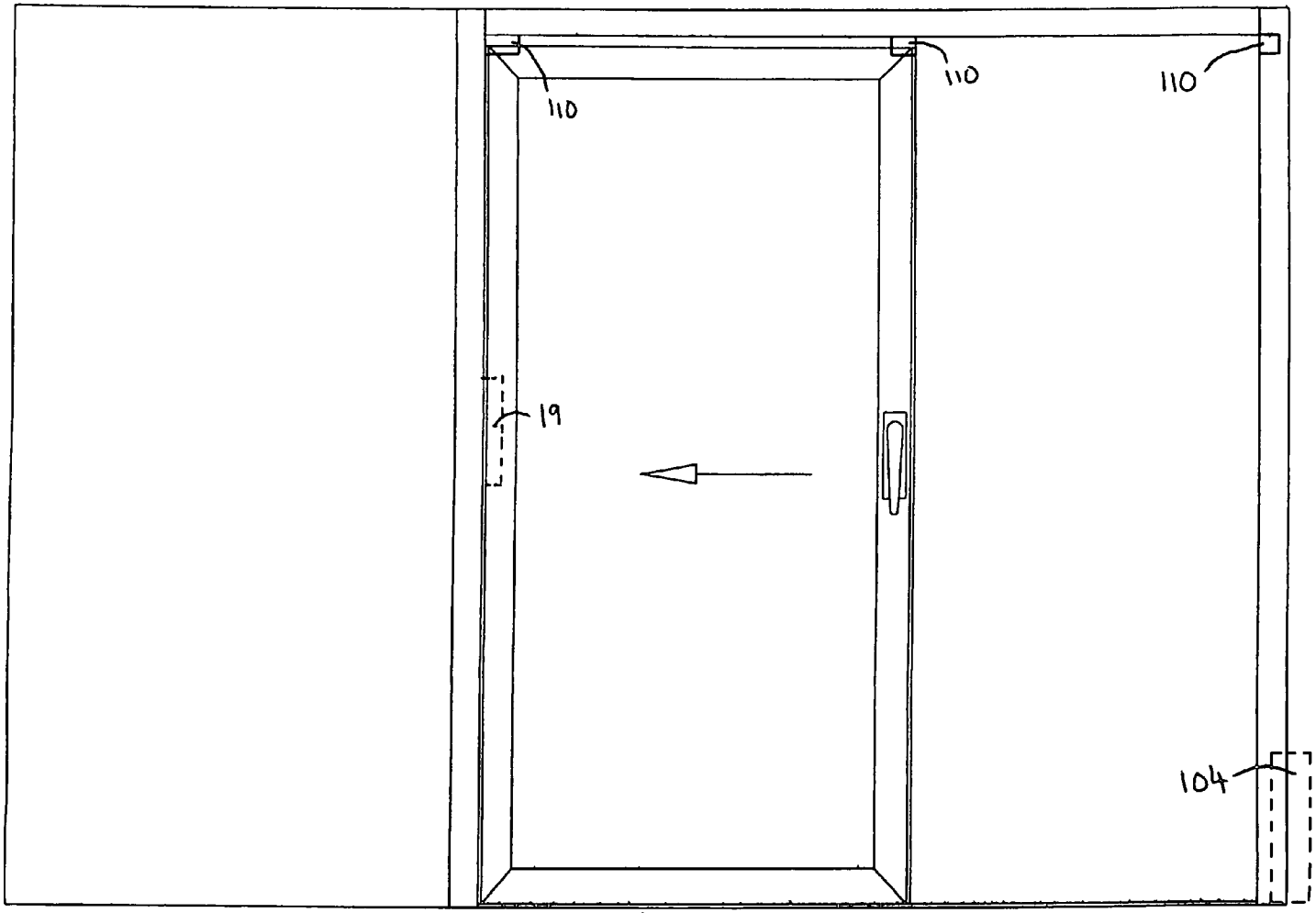
FIG. 25 is a front elevation view of a set of internally powered sliding panels according to one embodiment of the present invention, showing the electrical supply and connections.

The second motor 50 uses the same power supply as the first motor 28, namely the battery 19. The battery 19 is found only in the lead panel 10A, not in any other panel 10. The lead panel 10A is the first panel to move when its set of panels opens or closes, and it provides the force to move the other panels along the track. To provide electricity to the other panels in the system, they are all electrically connected to the lead panel 10A when the system is fully closed. As shown in FIG. 25, on the stile 18 of each panel 10 is a sliding connector 110A which engages with a complementary sliding connector 110B in the stile 18 of a neighboring panel 10 (or a side jamb 87) when the system is in the fully closed position. The tapered design of the engagement surfaces of the sliding connectors 110 (see FIG. 26) ensures that an electrical connection will be made and maintained even if the connectors are slightly misaligned, such as where two neighboring panels 10 do not raise precisely the same distance off the track 11, or where one panel raises before or after its neighbor.

Figure 26:
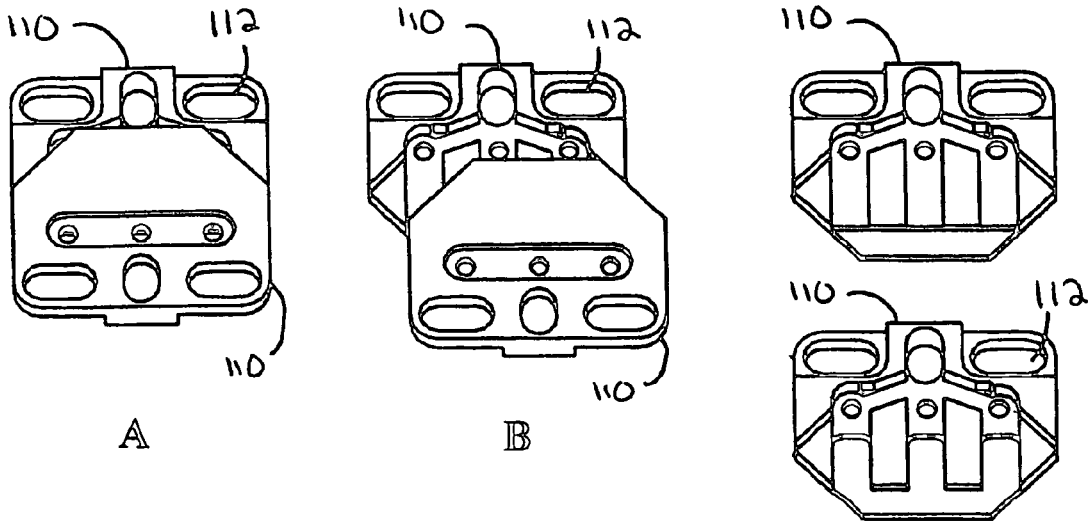
FIG. 26 is a perspective view of a sliding connector pair used to make electrical connections between adjacent panels in the fully closed position, the connectors shown fully engaged (A), partially engaged (B), and completely disengaged (C), according to one embodiment of the present invention.

As seen in FIG. 26, the sliding connectors 110 also have oval shaped mounting holes 112, which allows for translation of the connectors 110 relative to their mounting surface in an amount equal to the distance the panel 10 lifts off the track 11. This is necessary to maintain an electrical connection and prevent damage to the sliding connectors 110 when there is relative vertical motion between the surfaces to which the sliding connectors 110 are mounted. For example, the sliding connector 110 in the leading stile 18A of the lead panel 10A engages with a sliding connector 110 in the side jamb 87. Engagement occurs when the lead panel 10A is in the raised position. When the lead panel 10A subsequently lowers, there is relative motion between the lead panel 10A and the side jamb 87. Thus, the sliding connectors 110 must be able to slide on their mounts to maintain the connection without damage. Relative motion between the surfaces to which the connectors 110 are mounted also occurs between neighboring panels 10, which do not raise and lower simultaneously. Accordingly, when the system is fully closed, all of the panels 10 are electrically connected. Thus, one battery found only in the lead panel 10A can act as a power supply for every panel in the system, so long as the system is fully closed.

The sliding connectors 110 allow for electrical connection between three different wires, one for the positive terminal of the battery 19, one for the negative terminal, and one for a thermistor wire. These three wires allow for a redundant battery charge detector. The battery charger 104 can determine when the battery 19 is fully charged either by measuring a voltage difference using the positive wire, or by using the thermistor wire to measure the temperature of the battery 19. When the battery 19 is fully charged, it will begin to heat up if the battery charger 104 continues charging. The battery charger 104 senses when the battery 19 is above a critical temperature and shuts off. Thus, the three wire connection provided by the sliding connector 110 is an important safety feature that prevents overcharging.

According to a third exemplary embodiment of the present invention, as shown in FIGS. 14 through 22, a control system is provided for regulating the movement of automatic panels along a fixed path. A control system of the present invention comprises at least a plurality of sensors, but according to the present embodiment further comprises a programmable microcontroller 90. The microcontroller 90 monitors the status of a plurality of sensors to determine whether to activate or deactivate the first motor 28 or the second motor 50.

Figure 14:
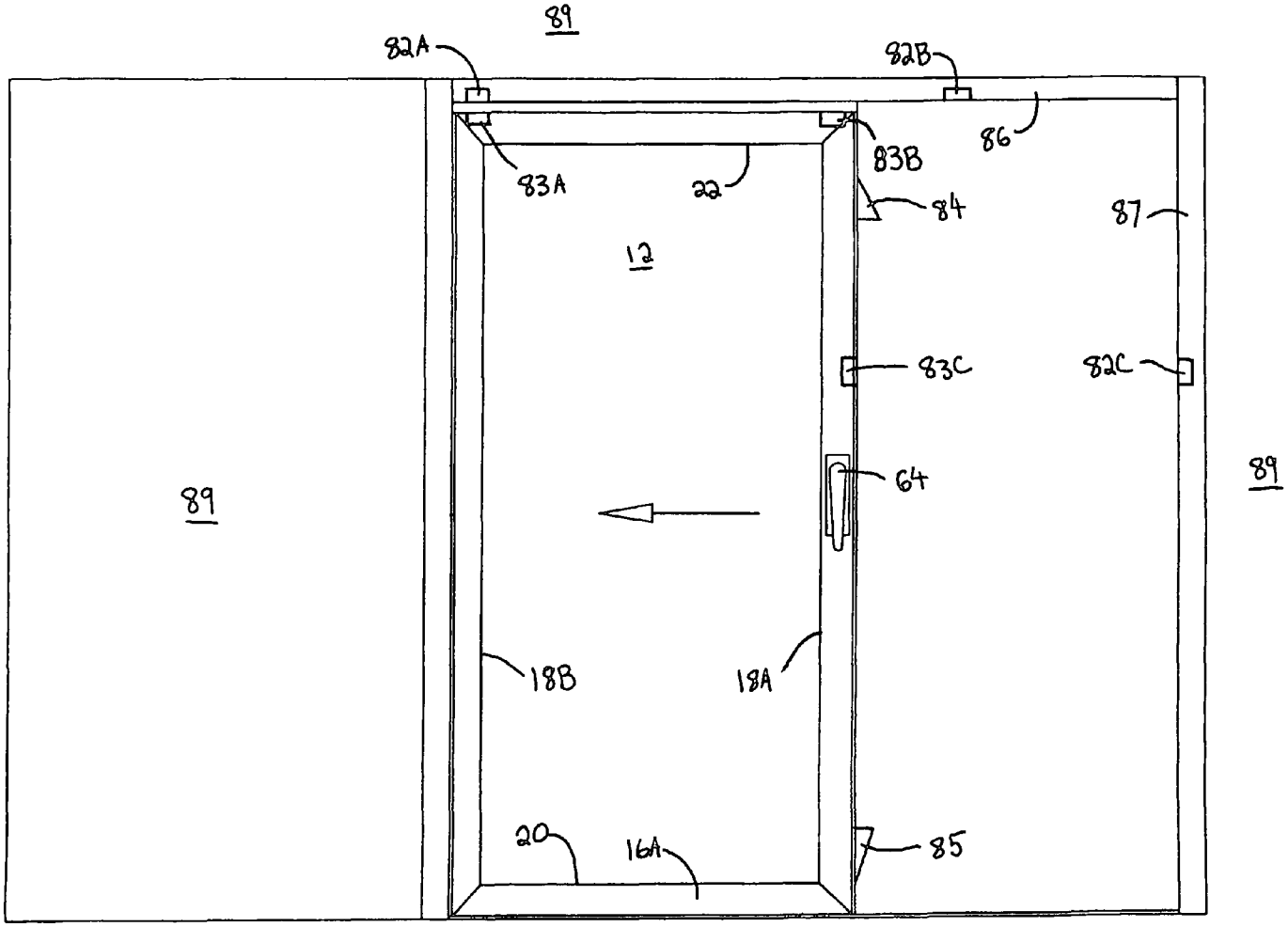
FIG. 14 is a front elevation view of an internally powered sliding panel according to a third embodiment of the present invention, showing the panel installed in a wall and the sensors used to control the movement of the panel along the track.

The control system of the present embodiment regulates the translation of the panel between three fixed positions along the track. These three fixed positions are referred to as open, closed, and access-door. As shown in FIG. 14, in which a lead panel 10A is shown in the fully open position, magnets are mounted in the head jamb 86 and side jamb 87 of the doorway at fixed positions corresponding to open (82A), access-door (82B), and closed (82C). Access-door refers to a person-sized opening such that the panel 10 does not need to move to the fully open position for a person to walk through. In installations in which the doors slide into a pocket upon opening, there is also a fourth magnet mounted in the pocket.

Magnetic sensors 83 are placed at strategic locations on the panel 10A to detect the presence or absence of the magnets 82. Magnetic sensor 83A is mounted in the trailing end of the upper rail 22, facing toward the head jamb 86. The magnet 82A and sensor 83A are configured such that when the sensor 83A is directly in line with the magnet 82A, the panel 10A is fully open. Another magnetic sensor 83B is mounted in the leading end of the upper rail 22, and senses the magnet 82B when the panel 10A is in the access-door position. A third magnetic sensor 83C is mounted in the leading stile 18A and senses the magnet 82C when the panel 10A is in the closed position. In embodiments of the invention in which two lead panels 10A meet in the middle of an opening in order to close it (as opposed to a single lead panel 10A contacting a side jamb 87 to close the opening), the magnet 82C is instead mounted in the leading stile 18A of the second lead panel 10A.

An encoder 106A counts rotations of the shaft of the first motor 28 and allows the central microcontroller 90A to determine approximately how far the panel 10A has traveled. Thus, the microcontroller 90A uses the encoder 106A to estimate when the panel 10A will reach a preset position marked by a magnet 82. Just prior to reaching the magnet 82, the central microcontroller 90A directs the first motor controller 96A to slow the rate of travel. This allows the panel 10A to stop moving precisely when it is aligned with the magnet 82 without overshooting it. An encoder 106B counts rotations of the shaft of the second motor 50. Variables stored in the central microcontroller 90A correspond to critical encoder values. An installer can adjust these variables to fine-tune the movement of the panel 10A and the amount the panels 10 lift off the track 11.

Figure 27:
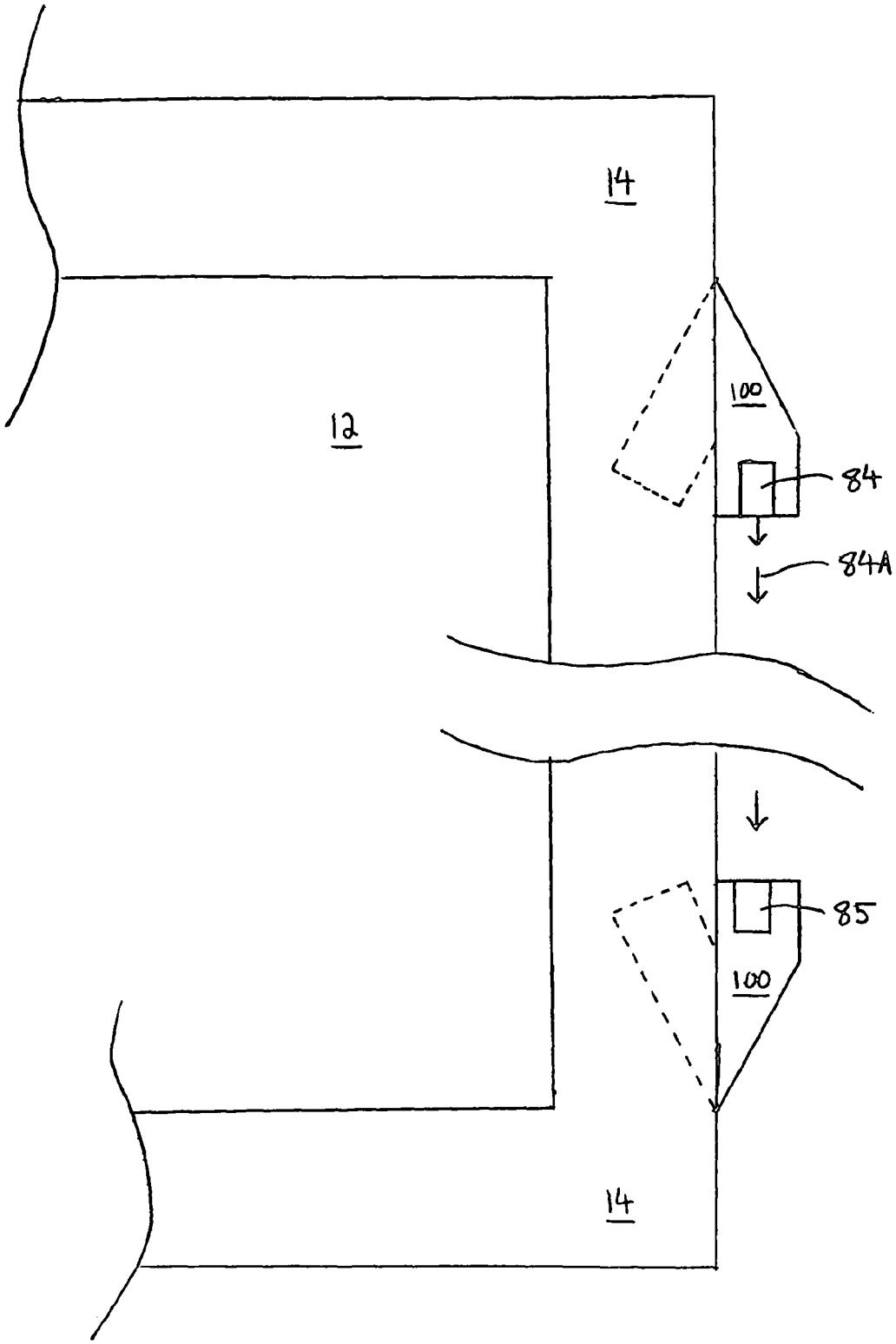
FIG. 27 is a front elevation view of a pair of hinged housings containing a light emitter and detector, according to one embodiment of the present invention.

Another sensor in the control system is an infrared (IR) beam detector 85 mounted on the leading and trailing edges of the frame 14. An IR beam emitter 84 emits an IR beam 84A toward the IR detector 85. As shown in FIG. 27, both the IR beam emitter 84 and the IR detector 85 are contained in collapsible, spring-loaded, hinged housings 100 that normally extend beyond the outer surface of the frame 14, but are collapsible into the frame 14 if pressure is applied to them. The beam 84A may be broken either by an obstruction passing through it, or if either housing 100 collapses into the frame 14. In installations where the panel is exposed to direct sunlight, it is preferable to have the emitter 84 below the detector 85, so that sunlight shining down does not interfere with the detector 85.

One difficulty with the collapsible housing 100 is that it causes the beam 84A to be broken instantly upon contact of the housing with the side jamb 87, even though a small gap remains between the panel 10 and the side jamb 87. To allow the panel 10A to fully close, the central microcontroller 90A is programmed to ignore the IR detector 85 if the closed-magnet sensor 83C detects the closed-magnet 82C. This allows the panel 10 to fully close even though the beam 84A is broken. A similar process is used to allow a panel 10 in a pocketing installation to reach the fully open position even though a pocket cover trips the IR detector 85. A pocket magnet is mounted in the pocket and trips a sensor when the panel 10 passes. When the sensor is tripped, the central microcontroller 90A ignores the IR detector 85, thus allowing the panel 10 to fully open into the pocket.

Figure 15:
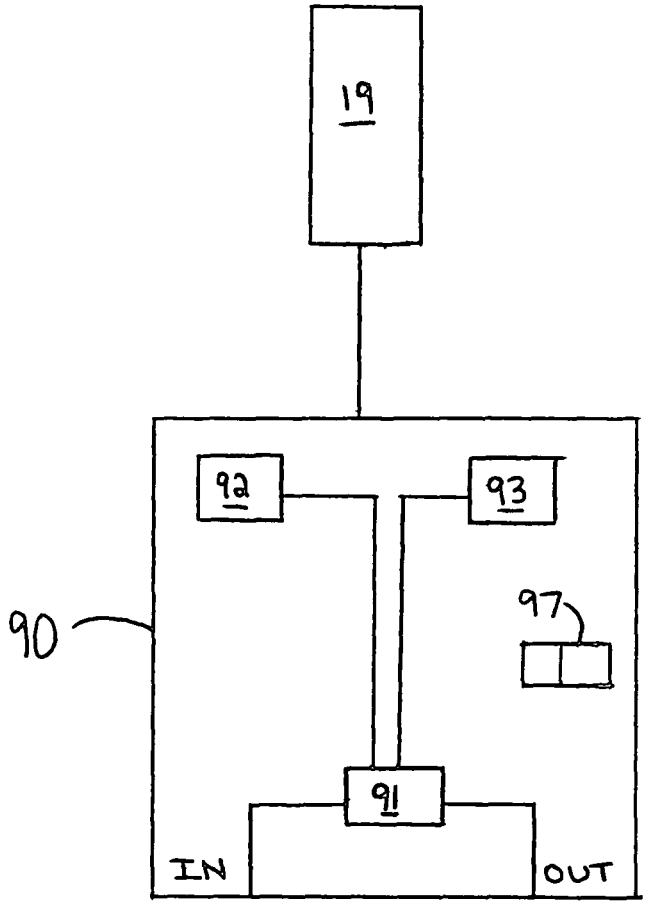
FIG. 15 is a schematic representation of a microcontroller used by the control system, according to one embodiment of the present invention.

As shown in FIG. 15, a microcontroller 90 of the control system primarily comprises a microprocessor 91, read-only memory (ROM) 92, random access memory (RAM) 93, a pair of DIP switches 97, and input and output (I/O) ports. As explained in further detail below, the microcontroller 90 can be in one of four different modes determined by the state of the DIP switches 97. The ROM 92 contains a program and a database of stored values used by the microcontroller 90. The microcontroller 90 loads the program into RAM 93 and then the microprocessor 91 executes the instructions. The sensors are connected to the microcontroller 90 via the I/O ports, either by wire or wirelessly. Also connected to the microcontroller 90 via the I/O ports, either by wire or wirelessly, are external input devices 95. These external input devices 95 may be a panel or wall mounted keypad, a remote control, or a connection to a home automation system. The microcontroller 90 constantly monitors the status of every sensor or input device 95 and compares their status with stored values in the ROM 92. Depending on the status of the sensors and input devices 95, the program directs the microcontroller 90 to either activate a motor, deactivate a motor, or do nothing at all.

One possible mode to which the microcontroller may be set is "central microcontroller" mode. This is the mode of a microcontroller 90A in the lead panel 10A. In a multi-panel system, the lead panel 10A is the panel that engages with the jamb 87 when the panel 10 is fully closed. As the lead panel 10A moves from the closed position to the open position, it engages with sub-panels and pushes them along the track. When the lead panel 10A reaches the fully open position, it is stacked with all the other panels at the end of the track. In a single panel system, the lead panel 10A is the only panel. The ROM 92 of the central microcontroller 90A contains a database of information about every other panel 10 in the system, such as the mode of each panel and the RF identity of each panel. The ROM of the central microcontroller 90A and of the lift microcontrollers 90B also contains variables that can be adjusted by an installer in order to optimize panel movement. These variables include panel lengths, motor speeds, and time variables.

Figure 16:
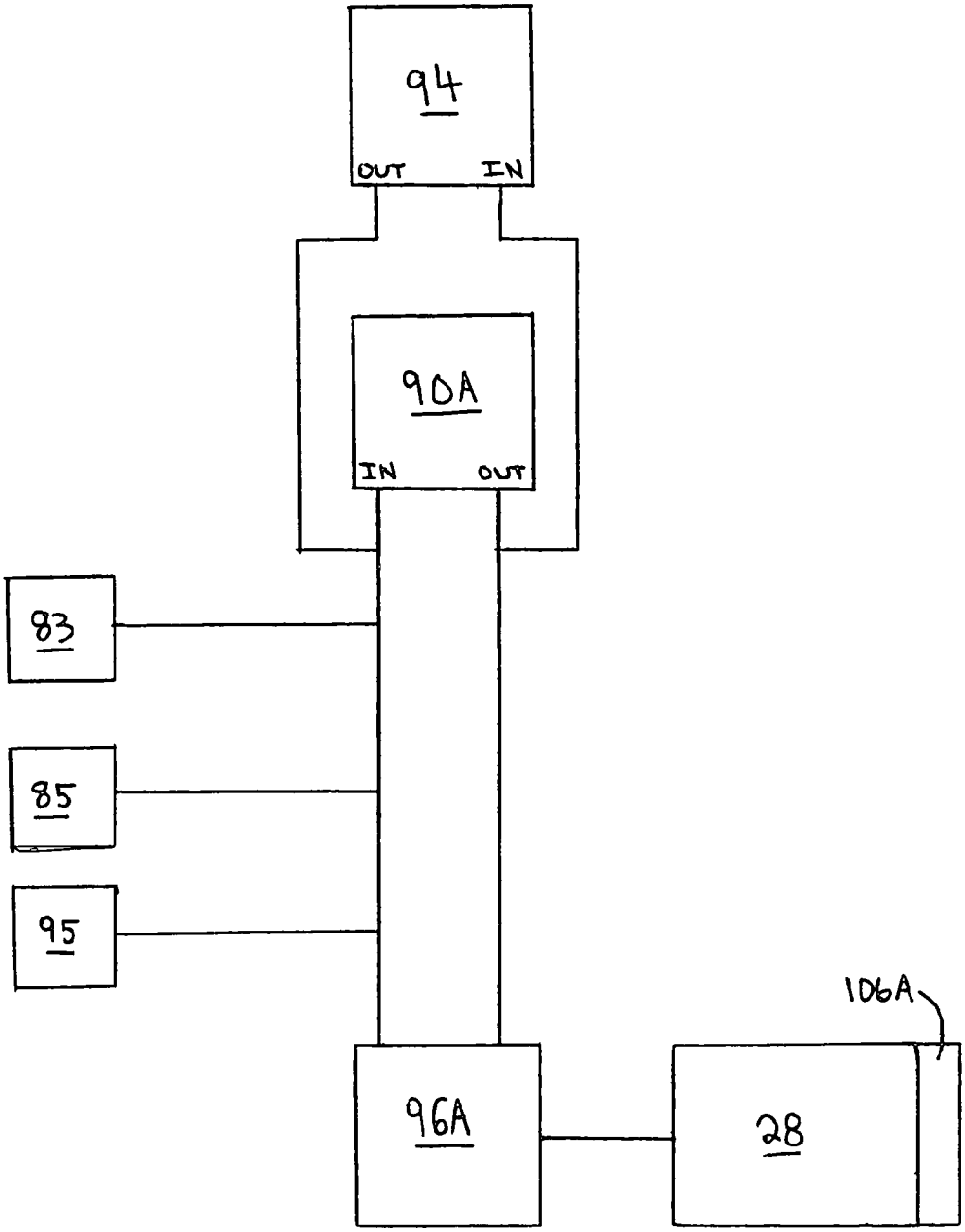
FIG. 16 is a schematic representation of the devices that directly communicate with a central microcontroller, according to one embodiment of the present invention.

As illustrated in FIG. 16, the central microcontroller 90A monitors a radio frequency (RF) transceiver 94, the magnetic sensors 83, the IR detector 85, the external input 95, and the first motor controller 96A. The central microcontroller 90A compares the status of these inputs to a database of stored values in the ROM 92 and uses the program stored therein to determine the appropriate action to take. These commands are transmitted by wire to the first motor controller 96A in the lead panel 10A, or wirelessly to any other component in the system.

In addition to central microcontroller 90A, the microcontroller 90 can be in three other modes, namely lift microcontroller 90B, secondary central microcontroller 90C, and assist microcontroller 90D. A pair of DIP switches 97 control the mode to which the microcontroller 90 is set. Thus, the microcontroller module 90 is identical for every mode, the only physical difference is the state of the DIP switches.

Figure 17:
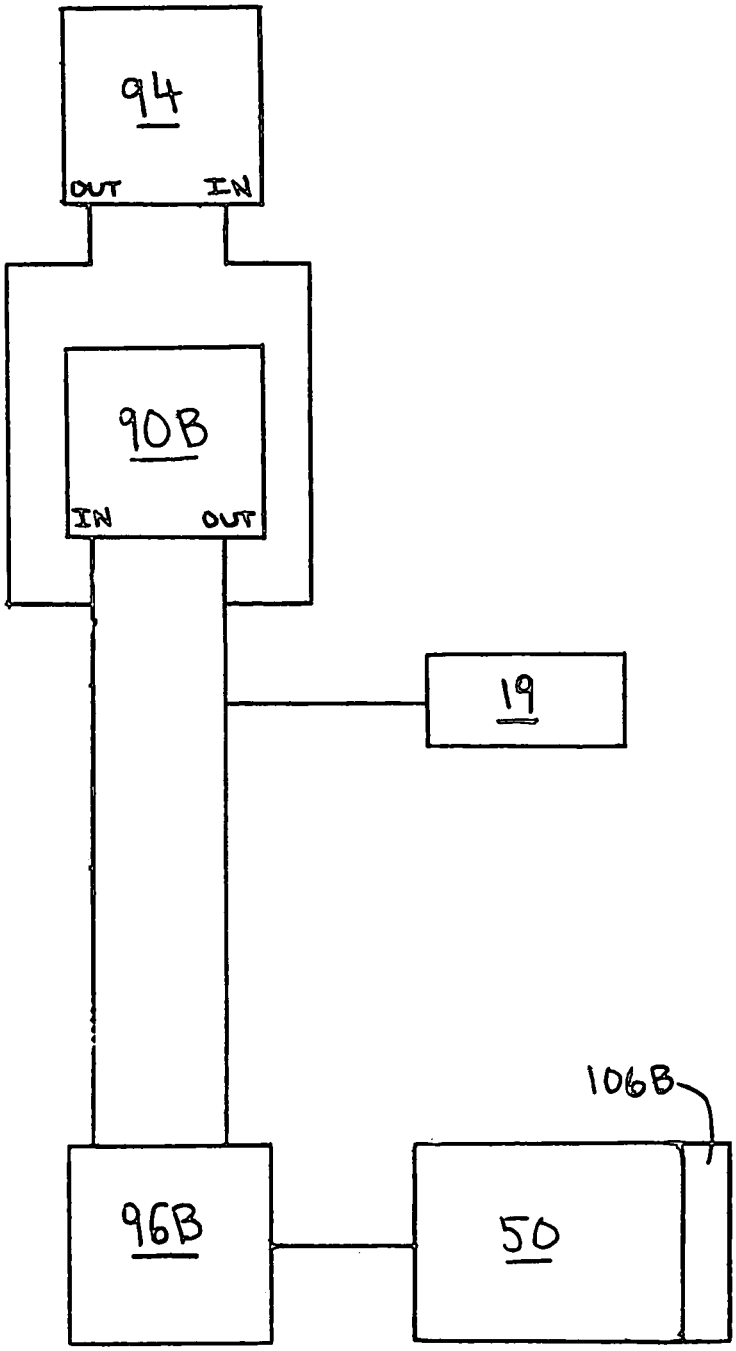
FIG. 17 is a schematic representation of the devices that directly communicate with a lift microcontroller, according to one embodiment of the present invention.

The lift microcontroller 90B, shown in FIG. 17, is found in every panel 10, and is primarily responsible for controlling the raising and lowering of its panel 10, communicating with the central microcontroller 90A, and resetting the battery charger 104. When the lift microcontroller 90B receives a raise or lower command from the central microcontroller 90A, the lift microcontroller 90B directs the second motor controller 96B to activate the second motor 50 in the proper direction. After the panel 10 is completely raised or lowered, the lift microcontroller 90B uses its RF transceiver 94 to transmit an "instruction complete" message, which is received by the central microcontroller 90A using its own RF transceiver 94.

The lift microcontroller 90B also keeps the battery 19 fully charged. Most battery chargers go into trickle mode after the battery is fully charged. However, the panels 10 of the present invention use more electricity when idle than the charger 104 provides in trickle mode. Thus, the battery 19 will lose its charge if the panels sit idle for too long. To solve this problem, the lift microcontroller 90B briefly electronically disconnects and reconnects the battery 19 from the charger. This resets the battery charger 104 back into fast charge mode. By programming the lift microcontroller 90B to periodically reset the battery charger 104, the battery 19 will not fully discharge when the system sits idle for long periods of time.

Figure 18:
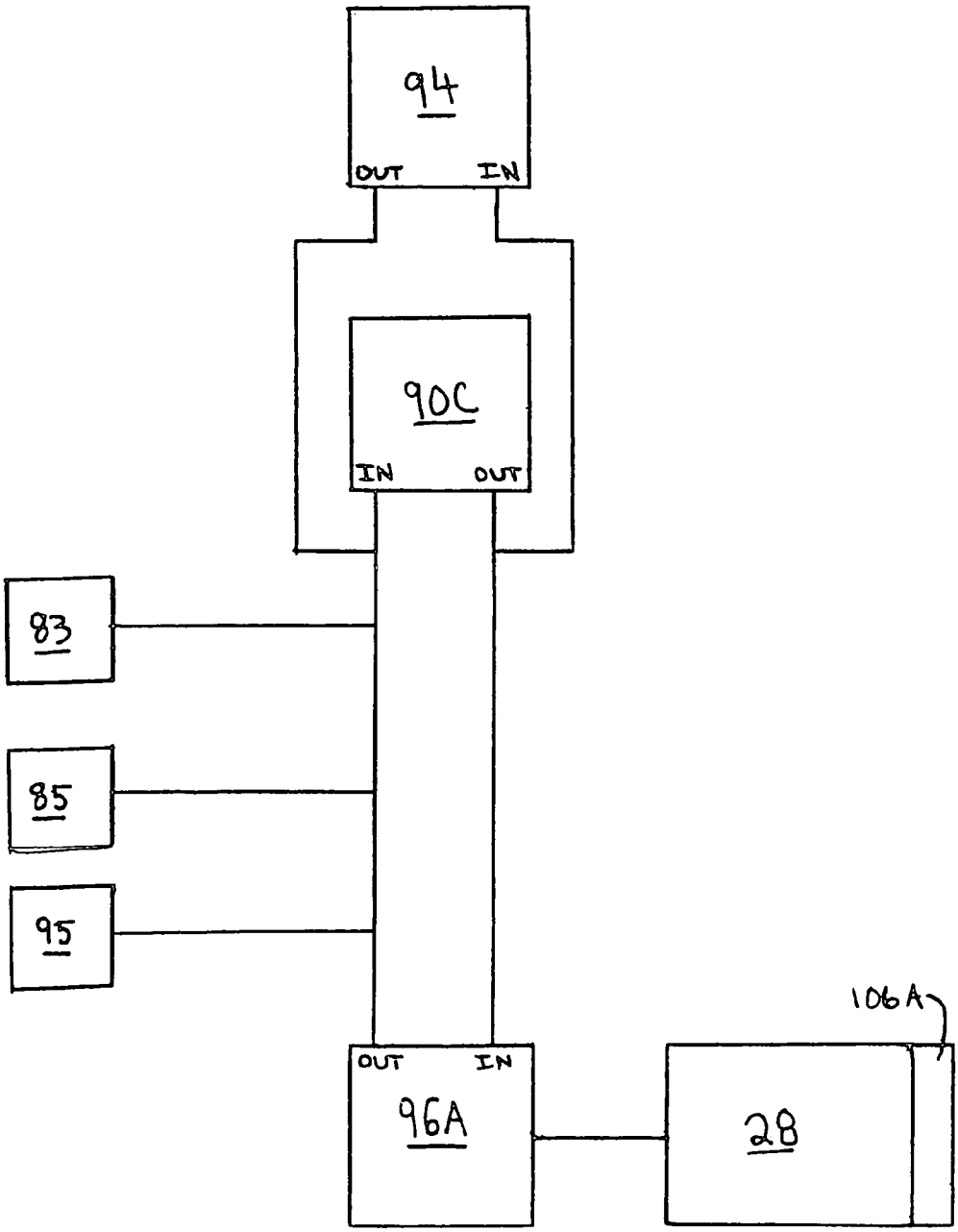
FIG. 18 is a schematic representation of the devices that directly communicate with a secondary central microcontroller, according to one embodiment of the present invention.
Figure 23A:
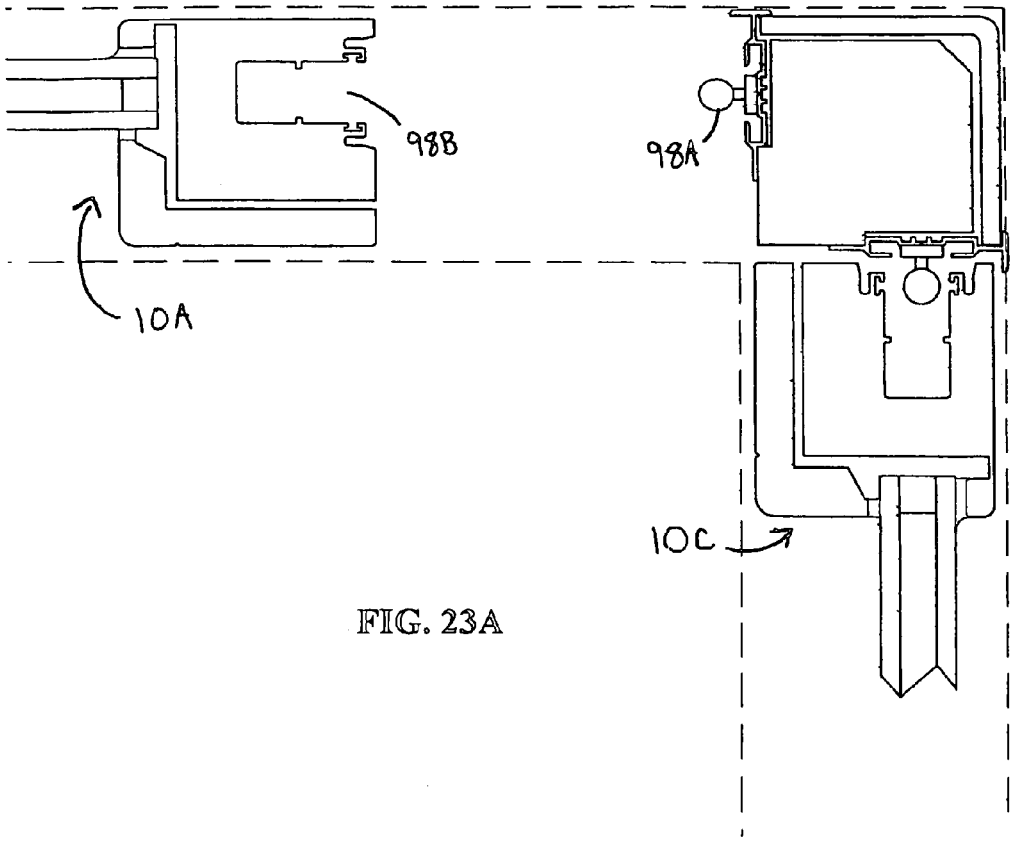
FIG. 23A is a top plan view of a primary lead panel and a secondary lead panel about to converge at an intersection of tracks, according to one embodiment of the present invention.
Figure 23B:
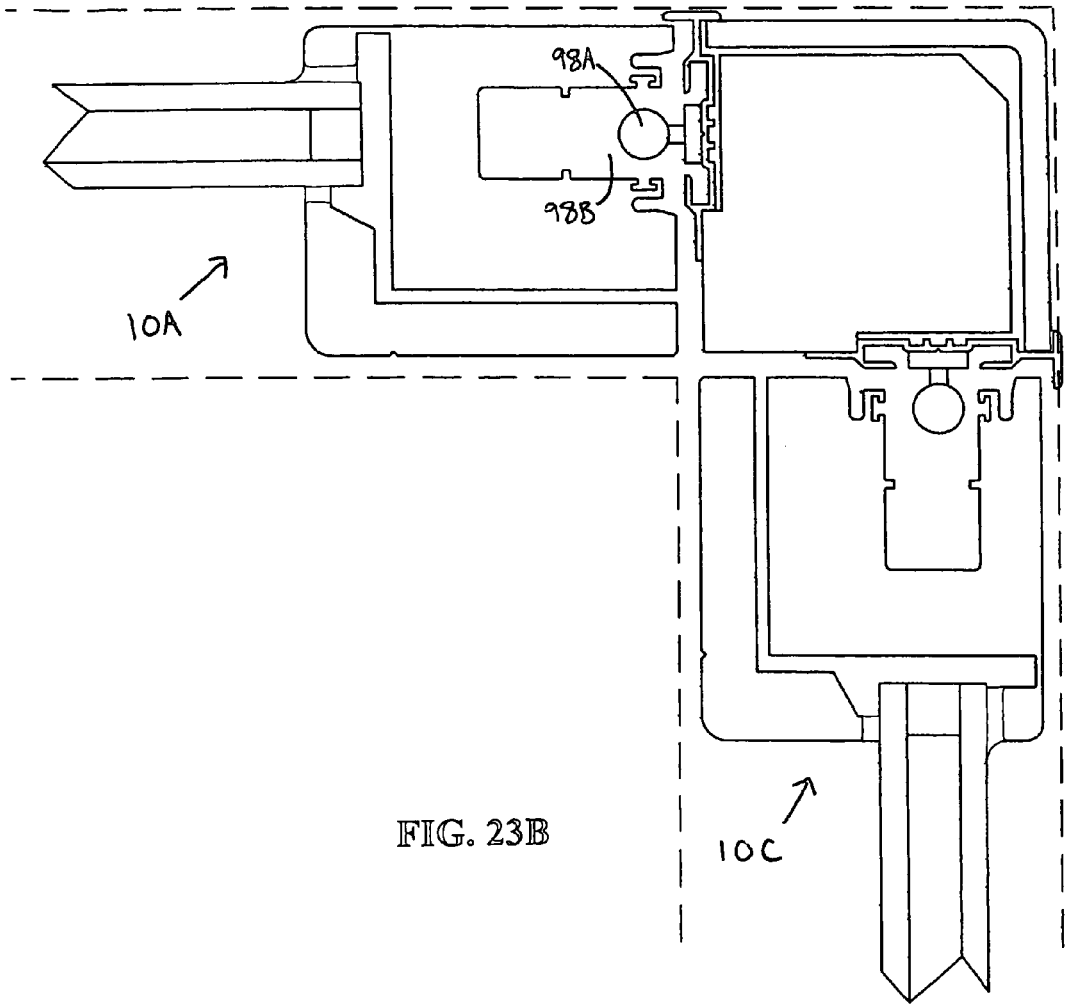
FIG. 23B is a top plan view of the panels of FIG. 23A, after the panels converge at an intersection of tracks.

A third mode for the microcontroller 90 is secondary central microcontroller 90C. The secondary central microcontroller 90C, shown in FIG. 18, is needed when two sets of panels converge at a corner, as illustrated in FIG. 23. When closed, locking pins 98A extending outwardly from the side of the frame 14 of the secondary lead panel 10C engage with holes 98B in the frame 14 of the primary lead panel 10A. Because of the engagement of these pins and holes 98, the two lead panels 10 cannot open simultaneously. Instead, the secondary lead panel 10C must wait until the primary lead panel 10A has moved away from the intersection, thus disengaging the pins and holes 98. Thus, the primary central microcontroller 90A instructs the secondary central microcontroller 90C to wait until the primary lead panel 10A is clear before instructing the secondary lead panel 10C to move.

Figure 19:
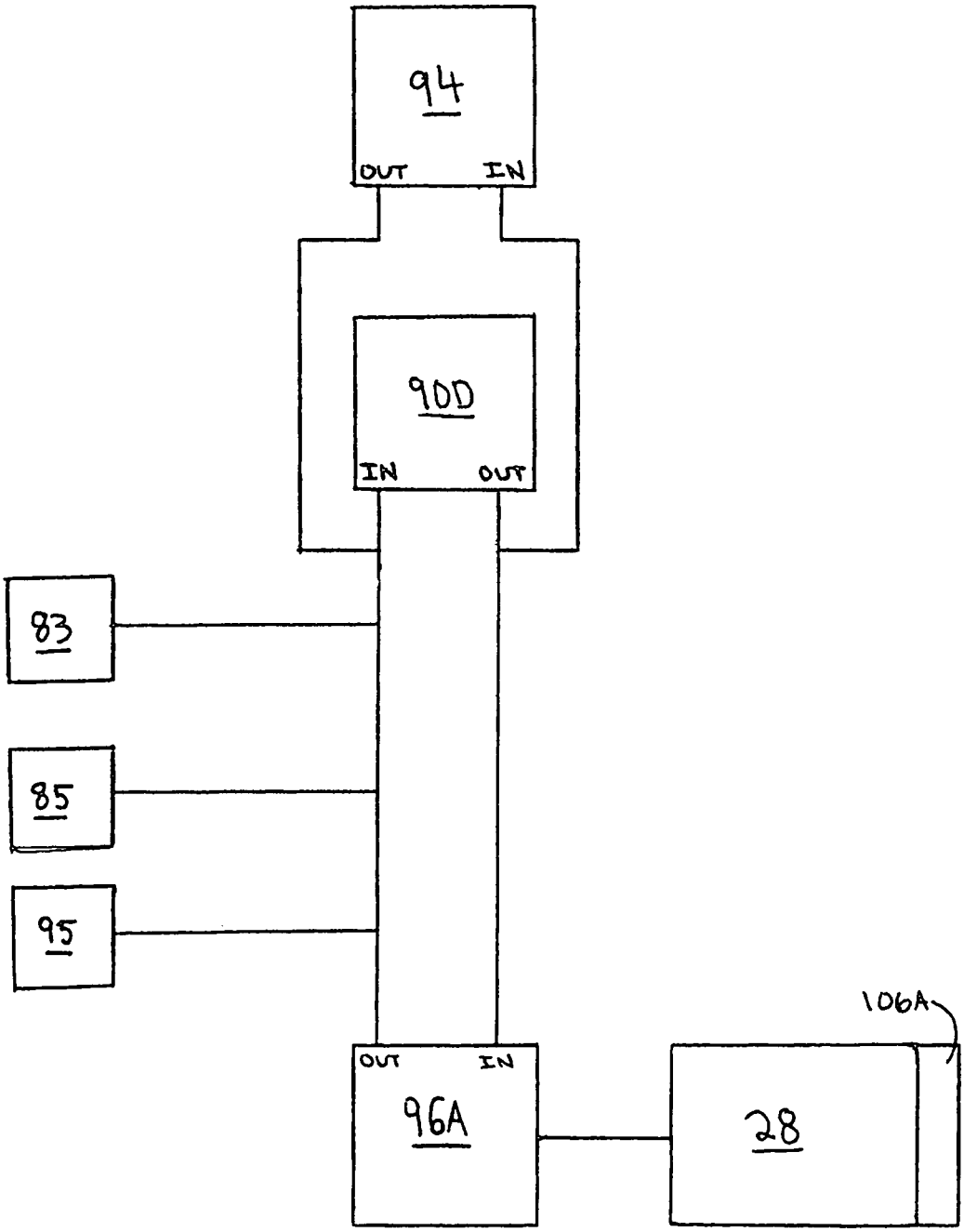
FIG. 19 is a schematic representation of the devices that directly communicate with an assist microcontroller, according to one embodiment of the present invention.

The fourth and final possible mode of the microcontroller is assist microcontroller 90D, shown in FIG. 19. In multi-panel systems, there is a critical total panel weight (approximately 1000 lbs) at which the wheels of the lead panel 10A may begin to slip under the load. Beyond this weight, one or more sub-panels must be outfitted with a first motor 28 and a drive train to help carry the load of the system. Such a sub-panel is referred to as an assist panel 10D, and it contains both a lift microcontroller 90B and an assist microcontroller 90D. An assist panel 10D raises and lowers in response to commands from the central microcontroller 90A just as any other sub-panel.

Figure 24:
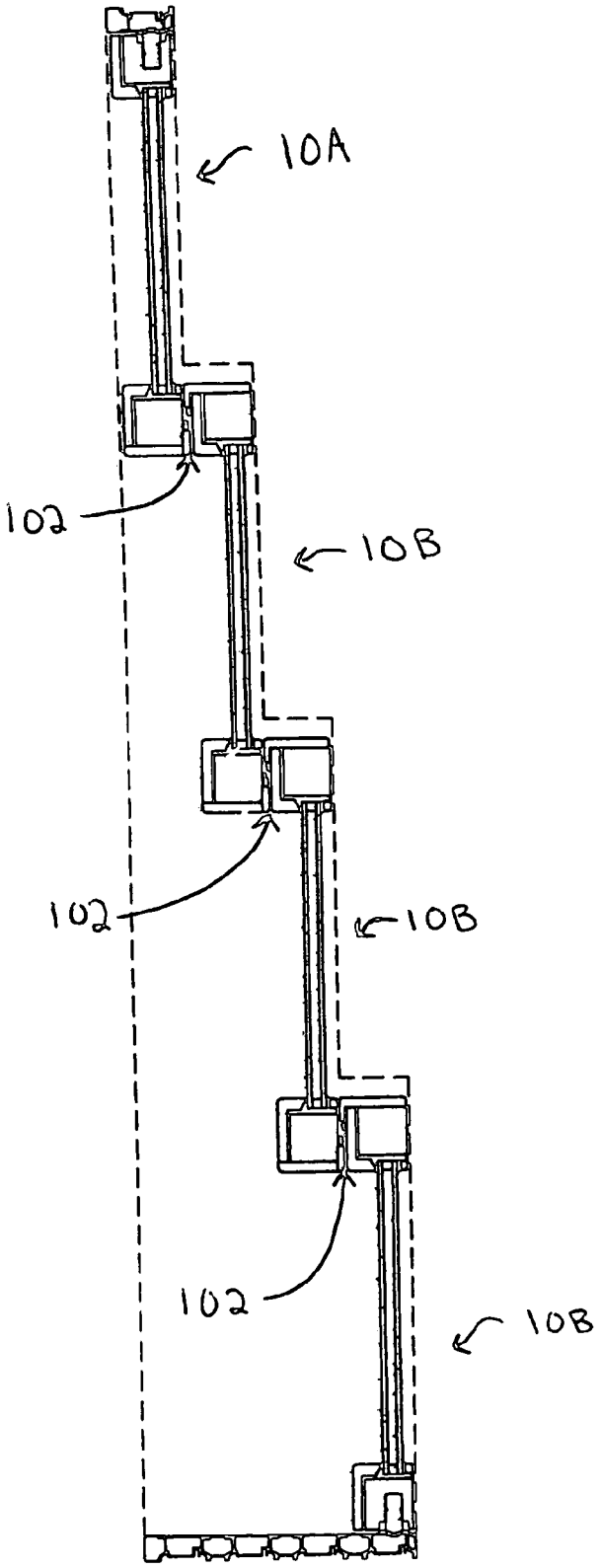
FIG. 24 is a top plan view of a set of stackable sliding panels comprising a primary lead panel and three subpanels, the set of panels shown in the fully closed position.

As shown in FIG. 24, in response to an open command from the external input 95, the lead panel 10A will move along the track 11 and pick up each sub-panel 10B that it passes. When the lead panel 10A reaches the first sub-panel 10B, a panel engager 102 on lead panel 10A contacts a panel engager 102 on first sub-panel 10B. This engagement causes sub-panel 10B to be carried along with lead panel 10A. This process repeats itself, as first sub-panel 10B has its own panel engager 102 that will engage with the second sub-panel 10B. Eventually, however, the total weight of the sub-panels 10B becomes too heavy for the lead panel 10A to drive without wheel slip. It is at this point that an assist panel 10D is required. When the lead panel 10A, and the sub-panels 10B carried along with lead panel 10A, reach assist panel 10D, the assist microcontroller 90D activates the first motor 28 of the assist panel 10D. Then, the lead panel 10A and the assist panel 10D work together to continue pushing other sub-panels 10B in the system to the fully open position. Magnets 82 in the head jamb 86 allow the assist microcontroller 90D to monitor the position of the assist panel 10D using magnetic sensors 83, much as the central microcontroller 90A uses magnets 82 to monitor the position of the lead panel 10A.

Figure 20:
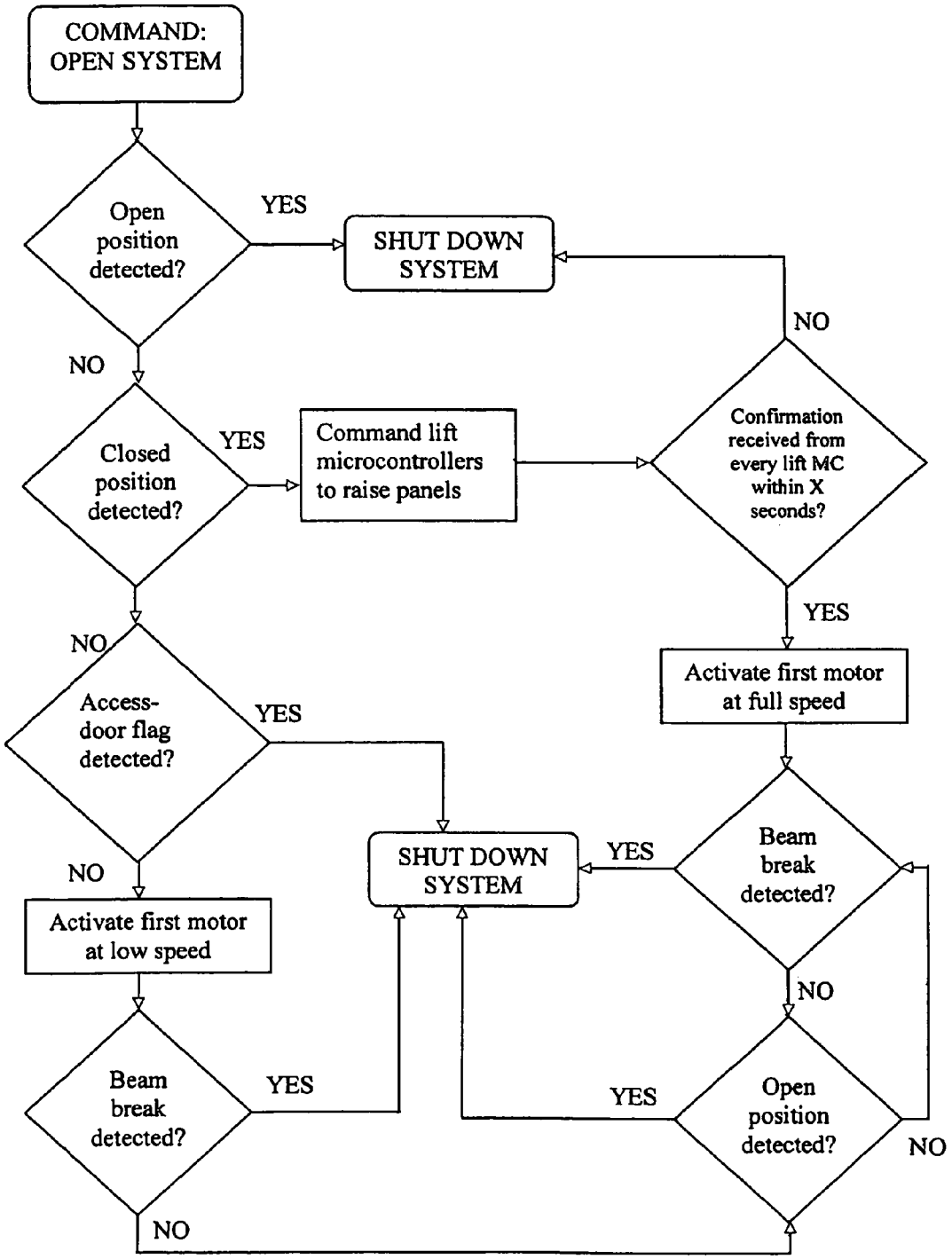
FIG. 20 is a flow chart showing the logic performed by a central microcontroller in response to an open command from an external input, according to one embodiment of the present invention.

The program logic executed by the central microcontroller 90A is discussed with reference to the flow charts of FIGS. 20 to 22. The central microcontroller 90A is found only in the lead panel 10A, and is responsible for controlling the first motor 28 via the first motor controller 96A, monitoring sensors, and communicating with other microcontrollers 90 in the system. For example, as seen in FIG. 20, when the central microcontroller 90A receives an input instruction of "open," the program first instructs it to check the current position of the panel 10A. If the magnetic sensor 83A indicates that the panel is already in the open position, or if an access-door software flag is set (by a process described below), the central microcontroller 90A shuts down the system. If the magnet sensor 83C indicates the panel is in the closed position, then the central microcontroller 90A executes instructions for opening the door, described in further detail below.

If instead the magnetic sensors 83 do not detect the presence of any magnet 82, and the access-door flag is not set, then the central microcontroller 90A cannot determine exactly where the panel is. In this situation, the program assumes that every panel is raised and that the lead panel 10A is somewhere between open and closed. The program directs the central microcontroller 90A to activate the first motor 28 at a slow speed, so that the lead panel 10A will travel slowly along the track 11. As it translates, the central microcontroller 90A is constantly monitoring the magnetic sensors 83. Eventually, the panel will reach the fully open position, the magnetic sensor 83A is tripped, and the system shuts down.

To execute the open command when the system starts in the fully closed position, the central microcontroller 90A directs every panel 10 in the system to raise. Every panel 10 contains a lift microcontroller 90B and lift system, but only the lead panel 10A contains a central microcontroller 90A and drive system (although secondary lead panels 10B and assist panels 10D also contain drive systems). The central microcontroller 90A uses its RF transceiver to wirelessly transmit the raise command to the lift microcontrollers 90B. The lift microcontroller 90B in each sub-panel receives the instruction via its own RF transceiver, and then executes the command. After the raise command is successfully executed, the lift microcontroller 90B wirelessly transmits an "instruction completed" message back to the central microcontroller 90A. The central microcontroller 90A waits until the "instruction completed" message has been received from every lift microcontroller 90B. Once this occurs, the central microcontroller 90A activates the first motor 28, and the lead panel 10A begins to move toward the open position.

At any time when the lead panel 10A is translating, the central microcontroller 90A will immediately shut down the system if the IR beam on the edge of the panel is tripped. This safety feature both protects children from being caught between the lead panel 10A and the jamb 87, as well as protects the lead panel 10A itself from crashing into obstructions that could damage it or its drive system. Furthermore, the first motor controller 96A monitors the current drawn by the first motor 28. If the first motor 28 draws excessive current, the first motor controller 96A deactivates the first motor 28 because the excessive current draw means the motor is experiencing an increased load, possibly due to an obstruction. The central microcontroller 90A then detects an error and shuts down the system. Thus, the control system has a redundant safety feature to ensure nothing is ever caught between a moving panel 10A and the jamb 87.

Referring now to the flow chart in FIG. 21, the program logic for performing the access-door operation is as follows. After receiving the access-door command, the central microcontroller 90A first determines its current position. If the access-door position is detected, the system shuts down. If the open position is detected, the system likewise shuts down without moving any panels. However, if the closed position is detected when the access-door command is received, the central microcontroller 90A sets a flag in its ROM. This flag tells the system that all of the panels are lowered and that therefore only the lead panel 10A must be raised and moved to put the system in the access-door position. The flag also tells the central microcontroller 90A that it must only wait for confirmation of the raised status of the lead panel 10A, not every panel.

Instead, if upon receipt of the access-door command, no magnets are detected, the position of the panel 10A is "unknown." The central microcontroller 90A then checks whether the access-door flag is set. If the flag is not set, then the system shuts down. If the flag is set, however, the central microcontroller 90A directs the panel to move slowly until the access-door position is detected. Because of how the flag is set, if the central microcontroller detects the flag, the panel must be somewhere between the closed and access-door positions. When the access-door magnet 82B trips the corresponding magnetic sensor 83B, the panel has reached the access-door position and the central microcontroller 90A deactivates the first motor 28 to shut down the system.

Figure 21:
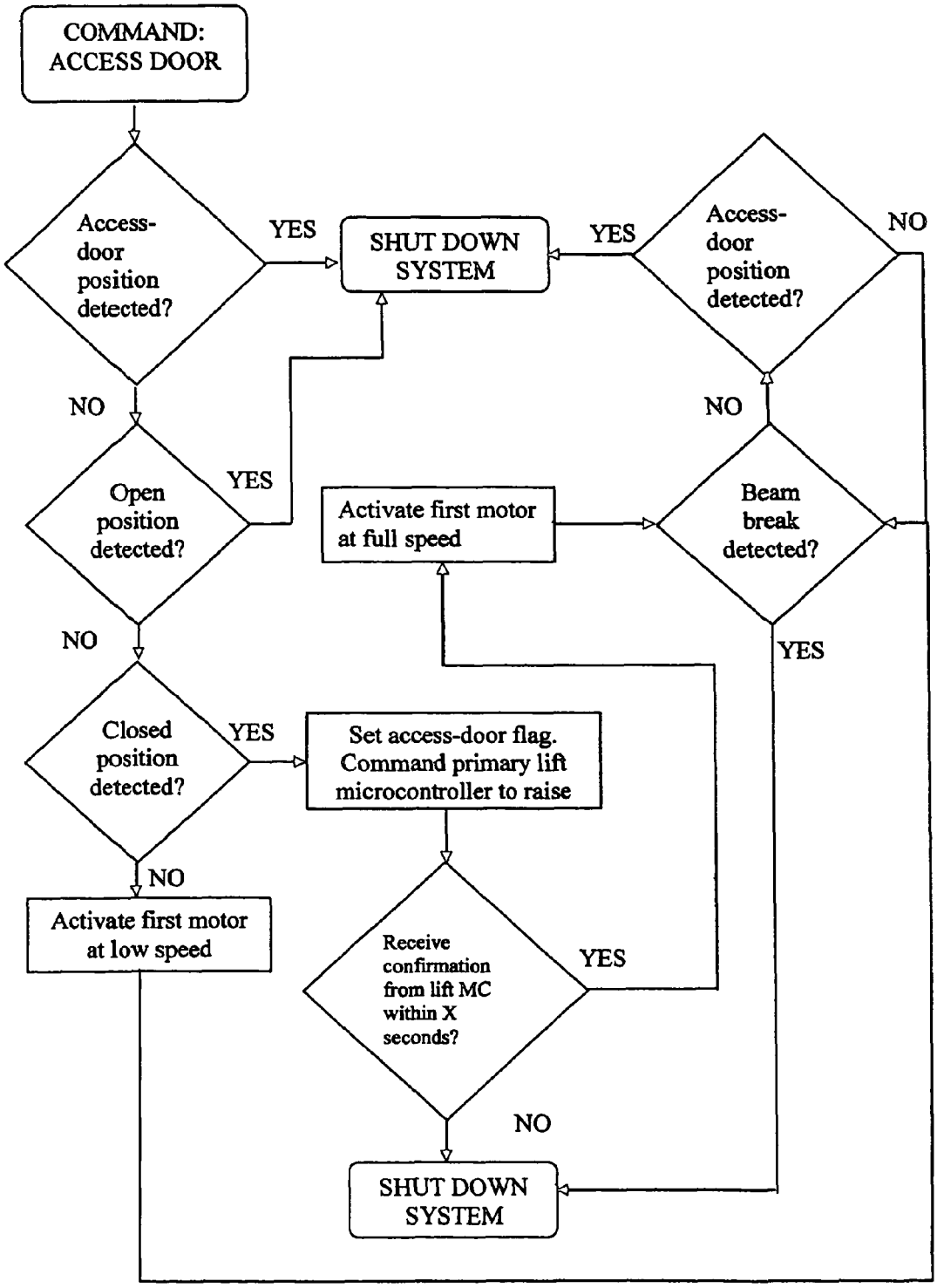
FIG. 21 is a flow chart showing the logic performed by a central microcontroller in response to a access-door command from an external input, according to one embodiment of the present invention.
Figure 22:
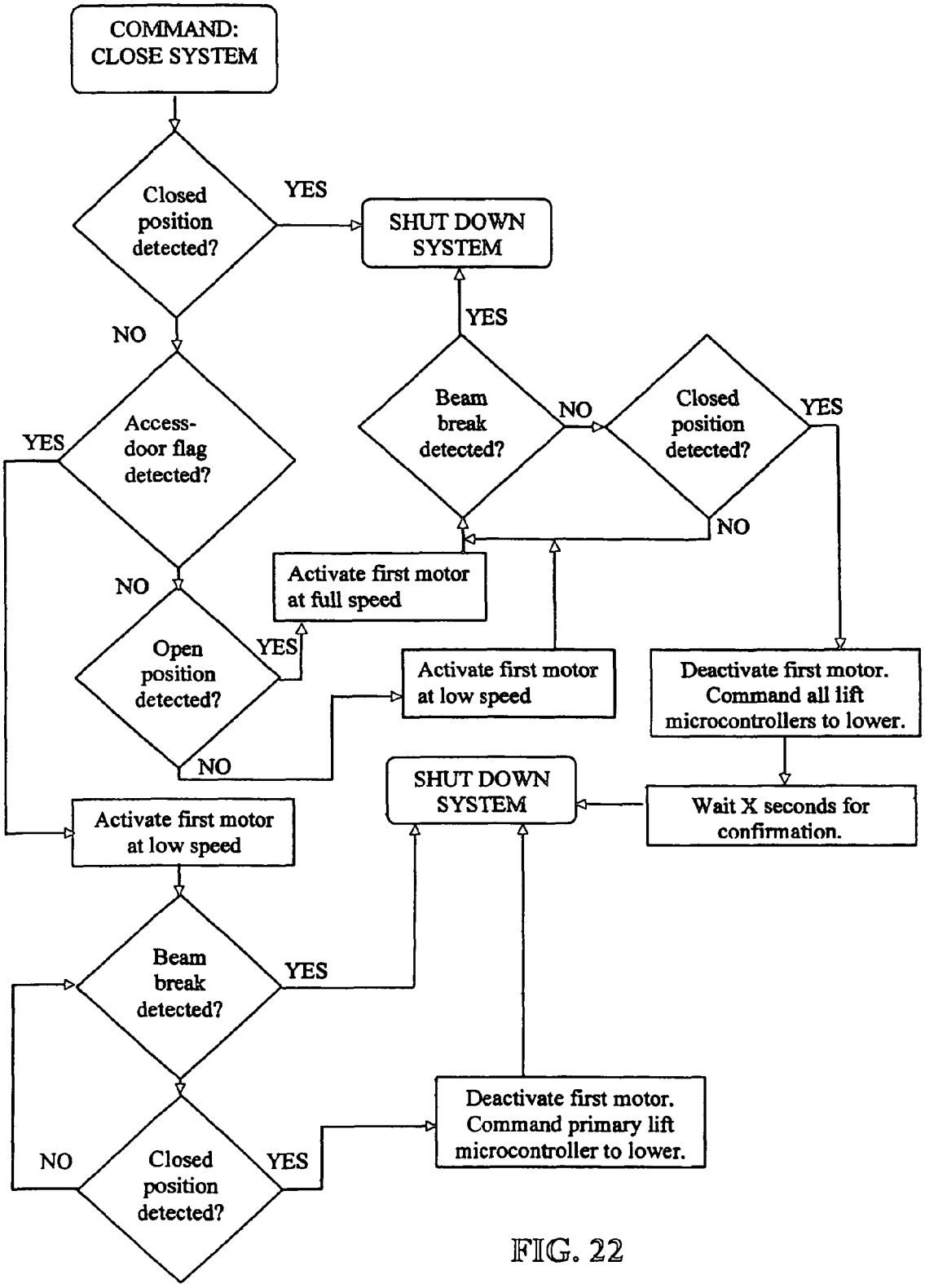
FIG. 22 is a flow chart showing the logic performed by a central microcontroller in response to a close command from an external input, according to one embodiment of the present invention.

Finally, the program logic for closing the panel is illustrated in the flow chart of FIG. 21. After receiving the close instruction from an external input 95, the central microcontroller 90A checks the current position of the panel 10A. If the closed position is detected, the central microcontroller 90A shuts down the system. If the open position is detected, the central microcontroller 90A directs the first motor controller 96A to activate the first motor 28 at full speed in order to move the panel 10A toward the closed position. As the panel 10A translates, the central microcontroller 90A constantly monitors the sensors, and when the closed position is detected it deactivates the first motor 28. Once the lead panel 10A reaches the closed position, the central microcontroller 90A wirelessly commands the lift microcontrollers 90B in all of the panels 10 to lower. After the instruction is executed, the sequence is complete.

If, upon receipt of the close command, no magnet is detected and the access-door flag is set, the program assumes that all panels are lowered except the lead panel 10A. The central microcontroller 90A commands the lead panel 10A to move to the closed position at low speed and lower itself after arrival. Alternatively, if no magnet is detected and the access-door flag is not set, the program assumes that all panels are raised. The central microcontroller 90A directs the lead panel 10A to move at low speed to the closed position. After arrival, the central microcontroller 90A commands every panel to lower.

A method of controlling the translation of a set of stacking panels on a fixed path between a fully closed position and a fully open position is also contemplated by the present invention. Stacking panels are supported on parallel (or concentric) tracks, and all move in unison after engaged by a neighboring panel moving past. Referring to FIG. 24, a lead panel 10A starts in the closed position. After an external input 95 directs the system to open, the central microcontroller 90A directs first motor controller 96A to activate the first motor 28, and thus the lead panel 10A begins to open. As the lead panel 10A moves, the central microcontroller 90A monitors the encoder 106A. When the central microcontroller 90A determines that the lead panel 10A is about to reach a sub-panel 10B, the central microcontroller 90A directs the first motor controller 96A to slow down the first motor 28. By doing this, the panel engagement member 102 of the lead panel 10A gently makes contact with the panel engagement member 102 of sub-panel 10B (as opposed to crashing into it at an excessive speed), then speeds up again until the process repeats itself when a second sub-panel 10B is reached. The central microcontroller 90A monitors a sensor that is triggered when the lead panel 10A reaches the fully open position. Once this position is reached, the central microcontroller 90A shuts down the system.

Variables in the program executed by the microcontroller correspond to the size of each sub-panel 10B. Thus, if the lead panel 10A is slowing down too soon or too late as it approaches a sub-panel 10B, the installer can modify the variable so that the lead panel 10A slows down at the optimum moment, namely just as the panel engagement members 102 are about to make contact.

A method of moving a plurality of lift and slide panels along a fixed path from a fully closed position to a fully open position is also contemplated by the present invention. After an external input 95 directs the system to open, the central microcontroller 90A commands each panel 10 in the system to raise. In response to this command, the lift microcontroller 90B in each panel 10 directs the second motor controller 96B to activate the lift motor 50, thereby raising the bottom surface of each panel out of contact with the surface supporting the wheels. The lift microcontroller 90B in each panel 10 transmits a confirmation message to the central microcontroller 90A after the panel 10 is fully raised. After receiving this confirmation, the central microcontroller 90A directs the first motor controller 96A to activate the first motor 28 at a first speed. After the central microcontroller 90A detects the open position, it shuts down the system and the sequence is complete. In an exemplary embodiment, the communication between the microcontrollers 90 is performed wirelessly. In another embodiment, this method further comprises the stacking process explained above, wherein the lead panel 10A slows down prior to engaging with sub-panels 10.

In another embodiment of the present invention, a method is provided for determining the position of an automatic sliding panel along a fixed path having at least three marked positions, wherein an object located at each marked position has a physical property that is detectable by a sensor in the panel. Depending on the status of the sensors in the panel, a logic unit can determine the position of the panel. If no magnets are detected, the logic unit commands the panel to move slowly in one direction until a known position is detected.

Finally, according to another embodiment of the present invention, a method is provided for coordinating the movement of two automatic sliding panels from an open and unengaged position to a fully closed and engaged position, wherein each panel travels along its own fixed path, the two paths intersecting at a corner. In an exemplary embodiment, as shown in FIG. 23, a secondary lead panel 10C activates its drive motor and begins moving toward the intersection of the tracks. The primary lead panel 10A does not begin moving until after the secondary lead panel 10C reaches the intersection and wirelessly transmits a confirmation message. After receiving the confirmation message, the primary lead panel 10A moves toward the intersection, eventually making contact with the secondary lead panel 10C. As the panels come together, complementary engagement members 98 on each panel, such as pins 98A and holes 98B, engage with each other so that there is a solid connection between the panels.

Various modifications and alterations of the invention will become apparent to those skilled in the art without departing from the spirit and scope of the invention, which is defined by the accompanying claims. For example, it should be noted that steps recited in any method claims below do not necessarily need to be performed in the order they are recited. For example, in certain embodiments, steps may be performed simultaneously. The accompanying claims should be constructed with these principles in mind.

Furthermore, any element in a claim that does not explicitly state "means for" performing a specified function or "step for" performing a specified function is not to be interpreted as a "means" or "step" clause as specified in 35 U.S.C. §112, ¶ 6.

What is claimed is:

1. An internally powered sliding panel comprising:

a frame positioned around a perimeter of a panel, wherein the frame is located on a support surface, the frame comprising:

a first stile comprising an upper end and a lower end;

a second stile comprising an upper end and a lower end;

an upper rail attached to the upper end of the first stile and the upper end of the second stile;

a lower rail attached to the lower end of the first stile and the lower end of the second stile;

a pane supported in the frame of the panel;

a power supply contained internally within the frame;

a first drive motor contained internally within the frame and operatively connected to the power supply;

a driven wheel carriage connected to the lower rail of the frame, the driven wheel carriage comprising a driven wheel rotatably mounted on the driven wheel carriage, wherein the drive motor is operatively connected to the driven wheel to rotate the drive wheel within the driven wheel carriage;

a lift motor contained internally within the frame and operatively connected to the power supply; and a lift mechanism contained internally within the frame and operatively connected to the driven wheel carriage and the lift motor, wherein the lift mechanism is configured to translate the driven wheel carriage within the lower rail of the frame, and wherein translation of the driven wheel carriage by the lift mechanism raises and lowers the panel relative to the support surface.

2. A panel according to claim 1, wherein the sliding panel further comprises a second wheel carriage connected to the lower rail of the frame, the second wheel carriage comprising a rotating wheel mounted on the second wheel carriage, and wherein the second wheel carriage is operatively connected to the driven wheel carriage, wherein translation of the second wheel carriage by the lift mechanism translates the driven wheel carriage within the lower rail of the frame, and further wherein translation of the driven wheel carriage and the second wheel carriage raises and lowers the panel relative to the support surface.

3. A panel according to claim 2, wherein driven wheel carriage is operatively connected to the lift mechanism through the second wheel carriage.

4. panel according to claim 3, wherein the driven wheel carriage is operatively connected to the second wheel carriage by a rigid connecting rod contained internally within the lower rail.

5. A panel according to claim 1 that further comprises a drive train contained internally within the frame, the drive train operatively connecting the drive motor to the driven wheel in the driven wheel carriage.

6. A panel according to claim 5, wherein the drive train comprises a first drive train component contained internally within the first stile of the frame and a second drive train component contained internally within the lower rail of the frame.

7. A panel according to claim 1 that further comprises a lift drive contained internally within the frame, the lift drive operatively connecting the lift motor to the lift mechanism.

8. A panel according to claim 7, wherein the lift drive is contained internally within the second stile of the frame.

9. A panel according to claim 1, wherein the lift mechanism comprises a first lift mechanism component contained internally within the second stile of the frame and a second lift mechanism component contained internally within the lower rail of the frame.

10. A panel according to claim 1, wherein the lift mechanism comprises:

a slide-block fixedly mounted on the lower rail of the frame, the slide-block comprising an aperture slanted relative to the lower rail of the frame; and a lift-pin fixedly mounted on the second wheel carriage, wherein the lift-pin is slidably engaged with the aperture of the slide-block.

11. A panel according to claim 1, wherein the lift mechanism comprises:

a pushrod having an input end and an output end, wherein the pushrod is contained internally within the second stile of the frame, and wherein the pushrod is translatable relative to the second stile of the frame;

a crank-arm having an input end and an output end, wherein the input end of the crank-arm is operatively connected to the lift drive, wherein the output end of the crank-arm is operatively connected to the input end of the pushrod, and wherein the crank-arm is contained internally within the second stile of the frame; and a pivoting arm having an input end and an output end, wherein the input end of the pivoting arm is pivotally connected to the output end of the pushrod, and wherein the output end of the pivoting arm is operatively connected to the second wheel carriage.

12. A panel according to claim 1, wherein the panel further comprises a control system operatively connected to the drive motor, the lift motor and the power supply, wherein the control system is contained internally within the frame, and wherein the control system is configured to operate the drive motor to move the panel on the support surface using the driven wheel and to operate the lift motor to raise and lower the panel relative to the support surface.

13. A sliding panel apparatus comprising:

a driven panel comprising a frame positioned around a perimeter of the driven panel, wherein the frame is located on a support surface, the frame comprising:

a first stile comprising an upper end and a lower end;

a second stile comprising an upper end and a lower end;

an upper rail attached to the upper end of the first stile and the upper end of the second stile;

a lower rail attached to the lower end of the first stile and the lower end of the second stile;

a pane supported in the frame of the driven panel;

a power supply contained internally within the frame;

a first drive motor contained internally within the frame and operatively connected to the power supply;

a driven wheel carriage connected to the lower rail of the frame, the driven wheel carriage comprising a driven wheel rotatably mounted on the driven wheel carriage, wherein the drive motor is operatively connected to the driven wheel to rotate the drive wheel within the driven wheel carriage;

a lift motor contained internally within the frame and operatively connected to the power supply; and a lift mechanism contained internally within the frame and operatively connected to the driven wheel carriage and the lift motor, wherein the lift mechanism is configured to translate the driven wheel carriage within the lower rail of the frame, and wherein translation of the driven wheel carriage by the lift mechanism raises and lowers the driven panel relative to the support surface;

a second panel comprising a frame positioned around a perimeter of the second panel, wherein the frame is located on a support surface, the frame comprising:

a first stile comprising an upper end and a lower end;

a second stile comprising an upper end and a lower end;

an upper rail attached to the upper end of the first stile and the upper end of the second stile;

a lower rail attached to the lower end of the first stile and the lower end of the second stile;

a pane supported in the frame of the second panel;

a wheel carriage connected to the lower rail of the frame of the second panel, the wheel carriage comprising a rotating wheel mounted on the wheel carriage;

a lift motor contained internally within the frame of the second panel and operatively connected to the power supply in the driven panel; and a lift mechanism contained internally within the frame of the second panel and operatively connected to the lift motor, wherein the lift mechanism is configured to translate the wheel carriage within the lower rail of the frame of the second panel, and wherein translation of the wheel carriage by the lift mechanism raises and lowers the second panel relative to the support surface.

14. An apparatus according to claim 13, wherein the driven panel and the second panel are positioned to close an opening in a wall when in a closed configuration, and wherein the lift motor in the second panel is not connected to the power supply in the driven panel when the driven panel and the second panel are not in the closed configuration.

15. An apparatus according to claim 13, wherein the lift motor in the second panel is operatively connected to the power supply in the driven panel through a first connector on the driven panel and a second connector on the second panel, wherein the first and second connectors connect the lift motor in the second panel to the power supply in the driven panel when the driven panel and the second panel are in the closed configuration.

16. An apparatus according to claim 15, wherein the first and second connectors are in contact with each other when the driven panel and the second panel are in the closed configuration and wherein the driven panel is raised relative to the support surface and the second panel is lowered relative to the support surface.

17. An apparatus according to claim 15, wherein the first and second connectors are in contact with each other when the driven panel and the second panel are in the closed configuration and wherein the driven panel is lowered relative to the support surface and the second panel is raised relative to the support surface.

18. An apparatus according to claim 15, wherein the first connector is mounted on the frame of the driven panel and the second connector is mounted on the frame of the second panel.

19. An apparatus according to claim 15, wherein the first connector is mounted on one of the first and second stiles of the driven panel and the second connector is mounted on one of the first and second stiles of the second panel.

20. An apparatus according to claim 13, wherein the driven panel further comprises a second wheel carriage connected to the lower rail of the driven panel, the second wheel carriage comprising a rotating wheel mounted on the second wheel carriage, and wherein the second wheel carriage is operatively connected to the driven wheel carriage, wherein translation of the second wheel carriage by the lift mechanism translates the driven wheel carriage within the lower rail of the driven panel, and further wherein translation of the driven wheel carriage and the second wheel carriage raises and lowers the driven panel relative to the support surface.

* * * * *